US007722389B2

(12) United States Patent
Benoit et al.

(10) Patent No.: US 7,722,389 B2
(45) **Date of Patent: *May 25, 2010**

(54) SHOCK-PROOF ELECTRICAL WIRING SYSTEM

(75) Inventors: John Benoit, Montpelier, VT (US); Gerald R. Savicki, Jr., Canastota, NY (US); Richard Weeks, Little York, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 31 days.

This patent is subject to a terminal disclaimer.

(21) Appl. No.: 12/107,147

(22) Filed: Apr. 22, 2008

(65) Prior Publication Data

US 2009/0186500 A1 Jul. 23, 2009

Related U.S. Application Data

(63) Continuation-in-part of application No. 11/691,116, filed on Mar. 26, 2007, now Pat. No. 7,470,145, which is a continuation of application No. 11/357,563, filed on Feb. 17, 2006, now Pat. No. 7,195,517, which is a continuation of application No. 11/032,420, filed on Jan. 10, 2005, now Pat. No. 7,189,110, which is a continuation-in-part of application No. 10/680,797, filed on Oct. 7, 2003, now Pat. No. 6,994,585, application No. 12/107,147, which is a continuation-in-part of application No. 11/933,928, filed on Nov. 1, 2007, now Pat. No. 7,642,457, which is a continuation of application No. 11/609,793, filed on Dec. 12, 2006, now Pat. No. 7,312,394, which is a continuation-in-part of application No. 10/900,778, filed on Jul. 28, 2004, now Pat. No. 7,179,992, which is a continuation-in-part of application No. 10/729,685, filed on Dec. 5, 2003, now Pat. No. 7,312,963.

(51) Int. Cl.
*H01R 13/60* (2006.01)

(52) U.S. Cl. ..... 439/535; 439/536; 439/143

(58) Field of Classification Search ..... 439/535, 439/536, 650, 143; 174/48, 50, 53, 66, 67; 220/241

See application file for complete search history.

(56) References Cited

U.S. PATENT DOCUMENTS

| | | | |
|---|---|---|---|
| 2,433,917 | A | 1/1948 | McCartney |
| 2,895,119 | A | 7/1959 | Montgomery, Jr. |
| 3,192,499 | A | 6/1965 | West |
| 3,879,101 | A | 4/1975 | McKissic |
| 3,952,244 | A | 4/1976 | Spear |

(Continued)

*Primary Examiner*—Tho D Ta
(74) *Attorney, Agent, or Firm*—Daniel P. Malley; Bond, Schoeneck & King, PLLC

(57) ABSTRACT

A shock-proof electrical wiring system includes a connector device having a connector housing. A plurality of connector contacts are disposed substantially inaccessible to a user within the connector housing. The plurality of connector electrical contacts are connected to a termination arrangement. The termination arrangement is configured to be connected to the portion of the plurality of AC electric power transmitting wires. An electrical wiring device includes a housing assembly that has at least one set of user-accessible receptacle openings disposed in a front major surface thereof in operative alignment with at least one shutter assembly configured to move from a closed position to an open position only in response to engaging a set of plug blades.

46 Claims, 11 Drawing Sheets

U.S. PATENT DOCUMENTS 3,967,195 A 6/1976 Averitt et al.
3,975,075 A 8/1976 Mason
4,008,940 A 2/1977 Foley
4,015,201 A 3/1977 Chaffee
4,034,284 A 7/1977 Peplow et al.
4,082,995 A 4/1978 Rhude
4,105,968 A 8/1978 Mobley et al.
4,118,690 A 10/1978 Paynton
4,127,807 A 11/1978 Peplow et al.
4,152,639 A 5/1979 Chaffee
4,280,092 A 7/1981 Wells, Jr. et al.
4,485,282 A 11/1984 Lee
4,725,429 A 2/1988 Scott
5,069,630 A * 12/1991 Tseng et al. ..... 439/137
5,117,122 A 5/1992 Hogarth
5,146,385 A 9/1992 Misencik
5,285,163 A 2/1994 Liotta
5,456,373 A 10/1995 Ford
5,625,285 A 4/1997 Virgilio
5,642,052 A 6/1997 Earle
6,054,849 A 4/2000 Collier et al.
6,072,317 A 6/2000 Mackenzie
6,218,844 B1 4/2001 Wong et al.
6,323,652 B1 11/2001 Collier et al.
6,457,988 B1 10/2002 Anderson
6,692,284 B1 2/2004 Koh
6,753,471 B2 6/2004 Johnson
6,767,245 B2 7/2004 King
6,814,611 B1 11/2004 Torres
6,870,099 B1 3/2005 Schultz
6,939,179 B1 9/2005 Kieffer, Jr.
6,982,558 B2 1/2006 Bryndzia et al.
7,057,401 B2 6/2006 Blades
7,068,038 B2 6/2006 Mason et al.
7,091,723 B2 8/2006 Simmons et al.
7,199,587 B2 4/2007 Hurwicz
7,259,567 B2 8/2007 Sears et al.

* cited by examiner

SHOCK-PROOF ELECTRICAL WIRING SYSTEM

CROSS-REFERENCE TO RELATED APPLICATIONS

This application is a continuation-in-part application of U.S. patent application Ser. No. 11/691,116 filed on Mar. 26, 2007, now U.S. Pat. No. 7,470,145 which is a continuation of U.S. patent application Ser. No. 11/357,563 filed on Feb. 17, 2006, now U.S. Pat. No. 7,195,517 which is a continuation of U.S. patent application Ser. Ser. No. 11/032,420 filed on Jan. 10, 2005, now U.S. Pat. No. 7,189,110 which is a continuation-in-part of U.S. patent application Ser. No. 10/680,797 filed on Oct. 7, 2003 now U.S. Pat. No. 6,994,585. This application is also a continuation-in-part application of U.S. patent application Ser. No. 11/933,928 filed on Nov. 1, 2007, now U.S. Pat. No. 7,642,457 which is a continuation of U.S. patent application Ser. No. 11/609,793 filed on Dec. 12, 2006, now U.S. Pat. No. 7,312,394 which is a continuation-in-part of U.S. patent application Ser. No. 10/900,778 filed on Jul. 28, 2004, now U.S. Pat. No. 7,179,992 which is a continuation-in-part of U.S. patent application Ser. No. 10/729,685 filed on Dec. 5, 2003, now U.S. Pat. No. 7,312,963 the contents of which are relied upon and incorporated herein by reference in their entirety, and the benefit of priority under 35 U.S.C. §120 is hereby claimed. Related subject matter is disclosed in U.S. patent application Ser. No. 11/531,812, filed on Sep. 14, 2006, the contents of which are incorporated by reference. Related subject matter is also disclosed in U.S. patent application Ser. No. 11/678,283, now U.S. Pat. No. 7,510,429, filed on Feb. 23, 2007, the contents of which are incorporated by reference.

BACKGROUND OF THE INVENTION

1. Field of the Invention

The present invention relates generally to electrical circuit installation, and particularly to electrical devices that facilitate installation of electrical circuits in a building or some other structure.

2. Technical Background

Installing electrical circuits in buildings and/or other structures is typically labor intensive, time-consuming, and a process that requires electricians of various skill levels. As a result the installation process is expensive. The first phase of the installation is commonly referred to as the "rough-in" phase. In new construction, either conduit or armored cable is disposed throughout the structure in accordance with the building plans. Junction boxes are installed at appropriate locations, and brackets and wiring device boxes are installed throughout the structure where electrical service is desired. Junction boxes, of course, are employed to house the connection point, or junction, of several conductors. Wiring device boxes are used to accommodate electrical wiring devices. For example, the types of electrical wiring devices may include, but are not limited to, receptacles, switches, dimmers, GFCIs, AFCIs, transient voltage surge suppressors (TVSS), protective devices, timer devices, sensors of various types including occupancy sensors, thermostats, lighting fixtures, and/or combinations thereof. After the boxes are placed, the electrical power conductor wires are pulled through the conduits and all of the circuits are bonded. At this point, the leads from the electrical wires extend from the boxes and are visible and accessible for the next phase of the installation process.

Before discussing the next phase of the process, it is noted that electrical cables may include two to five conductive wires. For example, in a structure that requires high power, the most common way of distributing that power is by employing the three-phase power system. As those of ordinary skill in the art recognize, five wires are employed. Three phase power includes three "hot" or "live" wires. Each of these wires transmits electrical power that is 120 degrees out of phase with the other two hot wires. The other two wires are the neutral conductor and the ground wire. Three phase power typically comes from the power utility via four wires: the three-phase wires, and the neutral. If the current flowing through each of the phases is equal, no current will flow through the neutral. The neutral wire is typically connected to the building ground at the structure's main distribution panel. The five wire cable is distributed from the central panel. Some of the circuits in the structure are designed to provide power to grounded equipment. These circuits may employ three wires, a line conductor (hot wire), a neutral conductor, and a ground. Some circuits may only employ two wires, the line conductor and the neutral conductor.

Referring back to the installation process, after the "rough-in" phase has been completed, the electrical wiring devices are terminated, i.e., they are electrically connected to the wire leads. This part of the installation process is the most costly and time consuming. A journeyman electrician must perform, or supervise, the connection of each wiring device in the structure. In this process, each electrical wire must be stripped and terminated to the device.

Once the electrical wiring device is terminated and power is applied, it begins its operational life span. Because safety is paramount, there are several safety issues that must be considered. One safety issue that must be considered relates to child-safely and is concerned with preventing the child from inserting foreign objects into the face receptacles. Another issue relates to safely disabling or tripping the device once an end-of-life condition has been reached. Yet another issue relates to safely replacing the wiring device once end-of-life has been reached.

What is needed, therefore, is an efficient, labor-saving, and cost effective means for terminating the electrical wires and coupling them to the individual devices. The electrical wiring device should be shock-proof, i.e., that it addresses the issues presented in the paragraph immediately preceding this one.

SUMMARY OF THE INVENTION

The present invention addresses the needs described above by providing an efficient, labor-saving, and cost effective means for terminating the electrical wires and coupling them to the individual devices. The system and method is cost-effective because it eliminates many of the labor intensive practices that are currently in use. The system of the present invention is also shock-proof, in that it prevents children from inserting foreign objects into the face receptacles, trips the device once an end-of-life condition has been reached, and may be safely and easily replaced without the possibility of shock.

One aspect of the present invention is directed to an electrical wiring system that includes a shock-proof electrical wiring system for use in an AC electrical power distribution circuit including a plurality of AC electric power transmitting wires disposed between an AC power distribution point and a device box, a portion of the plurality of AC electric power transmitting wires being routed into an interior portion of the device box. The system includes a connector device having a connector housing. A plurality of connector contacts are disposed substantially inaccessible to a user within the connector housing. The plurality of connector electrical contacts are connected to a termination arrangement. The termination arrangement is configured to be connected to the portion of the plurality of AC electric power transmitting wires. An electrical wiring device includes a housing assembly that has at least one set of user-accessible receptacle openings disposed in a front major surface thereof in operative alignment with at least one shutter assembly configured to move from a closed position to an open position only in response to engaging a set of plug blades. The at least one shutter assembly is secured within the housing assembly by a plurality of registration elements disposed along at least two orthogonal axes of the shutter assembly such that the at least one shutter assembly is substantially fixed along a first axis of the at least two axes, portions of the at least one shutter assembly being slidably movable between an open position and a closed position along the second axis of the at least two axes, the housing assembly including an AC circuit assembly coupled to at least one set of receptacle contacts disposed in substantial alignment with the at least one shutter assembly, the housing assembly further including a power input arrangement formed in a rear portion thereof, the power input arrangement including a set of power contacts configured to mate with the plurality of connector contacts within the connector housing to thereby establish electrically continuous paths between the plurality of AC electric power transmitting wires and the AC circuit assembly and the at least one set of receptacle contacts, the portion of the AC power transmitting wires being stowed within the interior portion of the device box when the electrical wiring device is mounted to the device box.

In another aspect, the present invention is directed to a shock-proof electrical wiring system for use in an AC electrical power distribution circuit including a plurality of AC electric power transmitting wires disposed between an AC power distribution point and a device box. A portion of the plurality of AC electric power transmitting wires are routed into an interior portion of the device box. The system includes a connector device including a connector housing and a plurality of female electrical contacts disposed substantially inaccessible to a user within the connector housing. The plurality of female electrical contacts are internally connected within the housing to a plurality of wire segments. The plurality of wire segments are configured to be connected to the portion of the plurality of AC electric power transmitting wires. An electrical wiring device includes a cover assembly having at least one set of user-accessible receptacle openings disposed in a major cover surface thereof in operative alignment with at least one shutter assembly. The at least one shutter assembly is configured to move from a closed position to an open position in response to engaging at least one set of plug blades and otherwise preventing an external object from making contact with the at least one set of face receptacle contacts. The device also includes a body member having an AC circuit assembly coupled to the at least one set of face-receptacle contacts disposed in substantial alignment with the at least one shutter assembly. The body member further includes a power input arrangement formed in a rear portion thereof. The power input arrangement includes a set of male power contacts configured to mate with the plurality of female connector contacts within the connector housing when the connector device is mated with the power input arrangement to thereby establish an electrically continuous path between the AC circuit assembly and the plurality of AC electric power transmitting wires such that the connector device is safely removable from the electrical wiring device when the electrical wiring system is energized.

In yet another aspect, the present invention is directed to a shock-proof electrical wiring system for use in an AC electrical power distribution circuit including a plurality of AC electric power transmitting wires disposed between an AC power distribution point and a device box. A portion of the plurality of AC electric power transmitting wires are routed into an interior portion of the device box. The system includes an insertable connector assembly having a plurality of connector contacts inaccessibly disposed in a connector housing characterized by a predetermined form factor, the connector assembly including a termination arrangement electrically coupled to the plurality of connector contacts and configured to terminate the portion of the plurality of AC electric power transmitting wires. An electrical wiring device includes a cover assembly having at least one set of user-accessible receptacle openings disposed in a major surface thereof and at least one frameless shutter assembly disposed in the cover assembly in substantial alignment with the at least one set of user-accessible receptacle openings. The at least one shutter assembly is configured to move from a closed position to an open position only in response to engaging a set of plug blades. The device includes a body member having a power input receptacle substantially conforming to the predetermined form factor and formed in a rear portion thereof. The power input receptacle includes a set of power contacts configured to mate with the plurality of connector contacts when the connector assembly is inserted in the power input receptacle preventing a foreign object from accessing an interior portion of the power input receptacle. At least one set of face receptacle contacts is coupled to the set of power contacts by a corresponding set of conductive paths and disposed in substantial alignment with the at least one shutter assembly. A fault protection mechanism is configured to interrupt at least one of the conductive paths in response to detecting a fault condition.

In yet another aspect, the present invention is directed to a shock-proof electrical wiring system for use in an AC electrical power distribution circuit including a plurality of AC electric power transmitting wires disposed between an AC power distribution point and a device box. A portion of the plurality of AC electric power transmitting wires are routed into an interior portion of the device box. The system includes a connector device having a housing and a plurality of female electrical contacts disposed substantially inaccessible to a user within the housing. The plurality of female electrical contacts are connected to a termination arrangement. The termination arrangement is configured to be connected to the portion of the plurality of AC electric power transmitting wires. An electrical wiring device includes a cover assembly having a power output arrangement disposed in a major surface of the cover assembly. The power output arrangement includes at least one set of user-accessible receptacle openings disposed in the major cover surface in operative alignment with at least one shutter assembly. The at least one shutter assembly is configured to move from a closed position to an open position in response to engaging at least one plug blade having a predetermined plug blade geometry and preventing an external object not having the predetermined plug blade geometry from making contact with the at least one set of face receptacle contacts. The electrical wiring device further includes a body member having an AC circuit assembly coupled to at least one set of face-receptacle contacts disposed in substantial alignment with the at least one shutter assembly. The body member further includes a power input arrangement formed in a rear portion thereof. The power input arrangement includes a set of male power contacts configured to mate with the plurality of female connector contacts within the connector housing when the connector device is mated with the power input arrangement to thereby establish an electrically continuous path between the AC circuit assembly and the plurality of AC electric power transmitting wires and preventing a foreign object from making contact with the set of male contacts. The connector device is safely removable from the electrical wiring device when the electrical wiring system is energized.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 3:
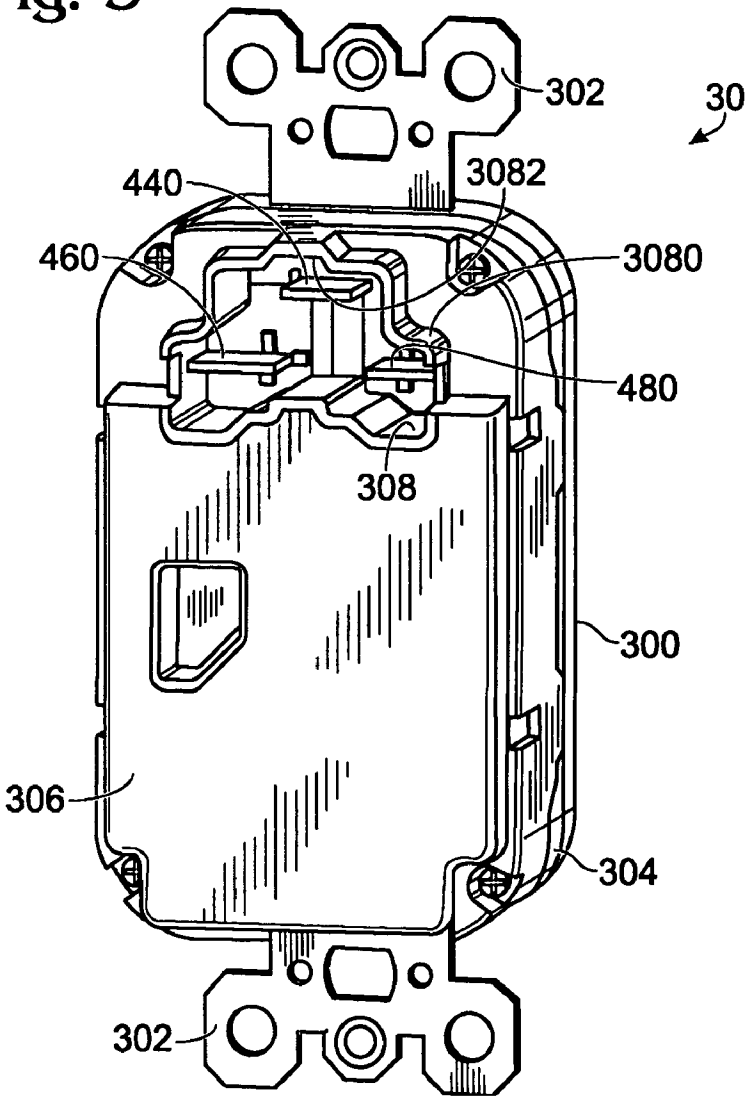
FIG. 3 is a bottom perspective view of the electrical wiring device shown in FIG. 1.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the system of the present invention is shown in FIG. 1, and is designated generally throughout by reference numeral 10.

Figure 1:
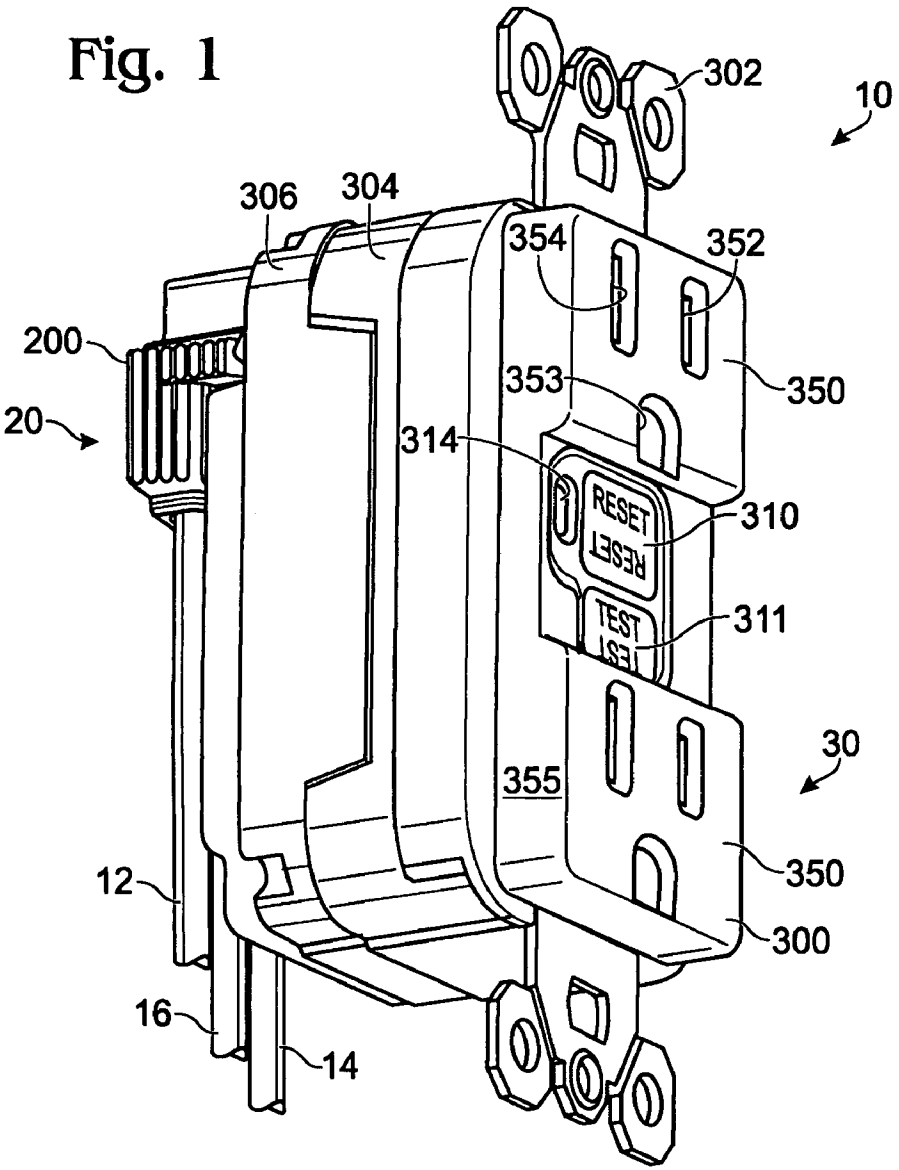
FIG. 1 is a top perspective view of an electrical wiring system in accordance with a first embodiment of the present invention.

As embodied herein, and depicted in FIG. 1, a perspective view of an electrical wiring system 10 in accordance with a first embodiment of the present invention is disclosed. System 10 includes a plug connector 20 that mates with electrical wiring device 30. Electrical power conductor wires (12,14, 16) are terminated by plug contacts disposed within plug housing 200. When plug 20 is installed in device 30, electrical continuity is established between the plurality of wires (12, 14,16) and the wiring device 30. One feature of the present invention is that it includes no external terminal connections. Power is provided to device 30 via plug connector 20. Service, depending on the nature of the device, is provided to the user via the front face. The present invention may be configured to accommodate 2 wire systems and three-phase (5 wire) systems, as well as the 3-wire system shown. Further, system 10 of the present invention may be adapted to a wiring system that employs more than 5 wires.

The exterior portion of wiring device 30 includes a cover 300, a separator portion 304, and a body member 306. A mounting strap 302 is disposed between the cover 300 and the separator 304. Body 306, separator 304 and cover 300 are injection molded components fabricated using materials such as polymers, polycarbonate, or nylon materials.

The cover member 300 includes a raised portion 350 disposed at either end. Each raised portion 350 is configured to accommodate a shutter assembly 100 (not shown in this view). Each raised portion 350 includes a set of receptacle openings including hot blade opening 352, neutral blade opening 354, and ground prong opening 353. The central portion of the cover member 300 includes a test button 311 a reset button 310 and a lens formed at the end of light pipe (trip indicator) 314 disposed in alignment with the reset button 310. When the indicator 314 is illuminated, the user is guided to the reset button 310. If the device has not reached an end-of-life condition, it will be reset when the reset button 310 is depressed by the user, and the light emanating from the trip indicator light 314 will be extinguished.

The mounting strap 302 may be fabricated using polymer, polycarbonate or nylon materials, a copper alloy or plated steel. When an electrically conductive material is used, strap 302 serves to ground an electrically conductive outlet box or mounting surface to the wiring device. When an electrically non-conductive material is used, the strap may be integral to body 306, separator 304, or cover 300.

Figure 2:
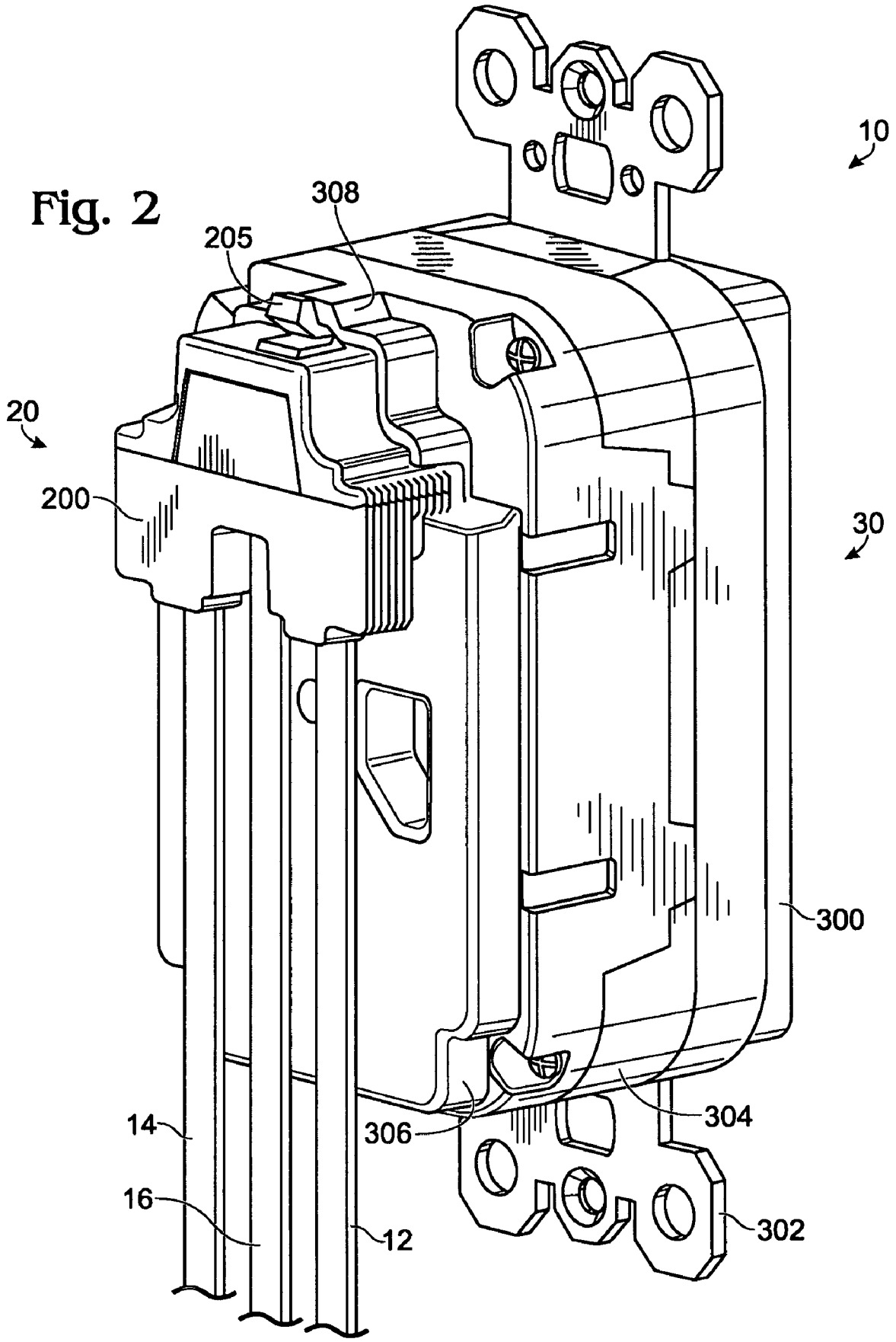
FIG. 2 is a bottom perspective view of the electrical wiring system shown in FIG. 1.

Referring to FIG. 2, a bottom perspective view of the electrical wiring system shown in FIG. 1 is disclosed. In this view, the plug connector 20 is shown in an inserted position within a receptacle 308 formed in the rear portion of electrical wiring device 30. The plug connector 20 shown in this embodiment features a novel 900 design such that the electrical power conductors (12,14,16) enter the plug connector at an angle of approximately 90° relative to the orientation of the contacts. This feature reduces the width dimension of the plug connector, allowing installation of the device in a greater variety of wiring boxes. By way of example, an elongated wiring box, commonly referred to as "raceway" restricts the width dimension of the device (depth behind the strap to the rearward surface of the plug connector) to less than about 1.70 inches. In one embodiment of the present invention, the width dimension (depth behind the strap to the rearward surface of the plug connector) is 1.52 inches. The conductor wires (12, 14,16) closely parallel the back surface of body member 306 in this embodiment. Plug 20 includes a housing 200 and connector contacts (which are disposed within body 200 and therefore not shown in the Figure). In the embodiment shown, connector contacts 202 are female contacts designed to accept male contacts disposed within wiring device 30. However, those of ordinary skill in the art will understand that system 10 may be designed the other way around, i.e., with male plug contacts and female device contacts.

Referring to FIG. 3, a bottom perspective view of the electrical wiring device 30 shown in FIG. 1 is disclosed. Receptacle opening 308 is disposed in one end of body member 306. Receptacle opening 308 consists of a molded plastic material that is shaped to accommodate the plug connector 20. The receptacle opening 308 may included a perimetric wall 3080 that is designed to abut the plug connector 20 when it is fully inserted therein. The perimetric wall 3080 may include a receptacle latch portion 3082 that is configured to coupled with a corresponding latch mechanism disposed on plug connector 20. The interior portion of the receptacle opening 308 includes receptacle hot contact blade 460, receptacle neutral contact blade 480, and the receptacle ground blade 440 disposed in a predetermined geometric relationship that facilitates mating with plug connector 20.

Figure 4:
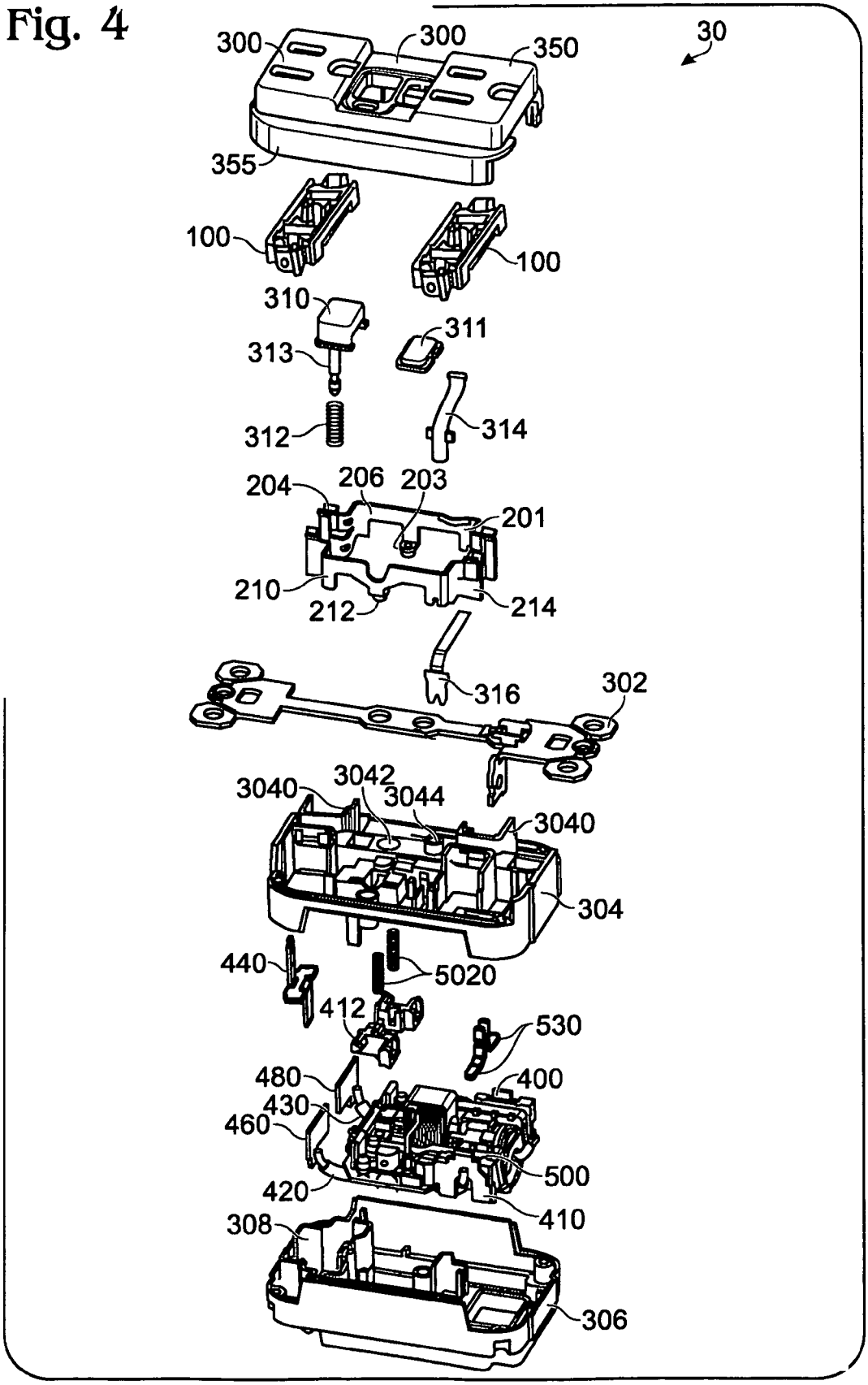
FIG. 4 is an exploded view of the electrical wiring device depicted in FIG. 1.

Referring to FIG. 4, an exploded view of the electrical wiring device 30 depicted in FIG. 1 is disclosed. The electrical wiring device 30, of course, includes a full duplex style cover member 300 having two raised portions 350 that are configured to accommodate the shutter assemblies 100 as shown. Cover member 300 also includes lateral skirt portions 355 which are configured to cover the lateral portions of the face receptacle terminal structures (201, 210). In the exploded view, the reset button and pin 310 are clearly shown. The reset button is accessible via the front cover and the attached reset pin is inserted into spring member 312 and a corresponding aperture 3042 within separator 304. The reset pin, of course, is ultimately disposed within the latch block 412 and is configured to move between a reset position and a tripped position.

The test button 311 is also accessible via the front cover and is employed by a user to move the test blade 316 in a downward direction. A lead from a test resistor R1 (not shown in this Figure) extends from tower 3044. When the test blade 316 is pressed by the user in a downward direction such that it contacts the lead of resistor R1, a current path is established between the line neutral and the load hot to simulate a fault condition. See also FIG. 10.

The separator member 304 accommodates the hot receptacle terminal structure 201 and the neutral receptacle terminal structure 210. The hot receptacle terminal structure 201 includes a hot fixed contact 203 disposed at an intermediate portion thereof and hot receptacle contact structures 204 formed at either end. The neutral receptacle terminal structure 210 includes a neutral fixed contact 212 disposed at an intermediate portion thereof and neutral receptacle contact structures 214 formed at either end. Therefore, both ends of device 30 include a shutter assembly disposed between a raised portion 350 and a set of hot and neutral receptacle contacts (204, 214). Note also that the separator 304 includes a shutter support structure 3040 disposed at either end. The mounting strap 302 is also disposed within the separator member 304 between the hot receptacle terminal structure 201 and the neutral receptacle terminal structure 210.

The electromechanical assembly 500 is disposed within back body member 306. The various components of the electromechanical assembly 500 are discussed in greater detail below. However, the hot terminal structure 400 is coupled to the electromechanical assembly 500 at one end and at another end to receptacle hot contact blade 460 by way of a black wire 420. In similar fashion, the neutral terminal structure 410 is coupled to the electromechanical assembly 500 at one end and at another end to receptacle neutral contact blade 480 by way of a white wire 430. Although it is not clearly shown in the Figure, the white wire 430 and the black wire 420 cross each other underneath the electromechanical assembly 500. The receptacle ground blade 440 is coupled to the ground strap 302. The contacts (460, 480, 440) are fabricated using copper alloy materials They may be plated with an electrically conductive material such as a tin alloy.

Figure 5:
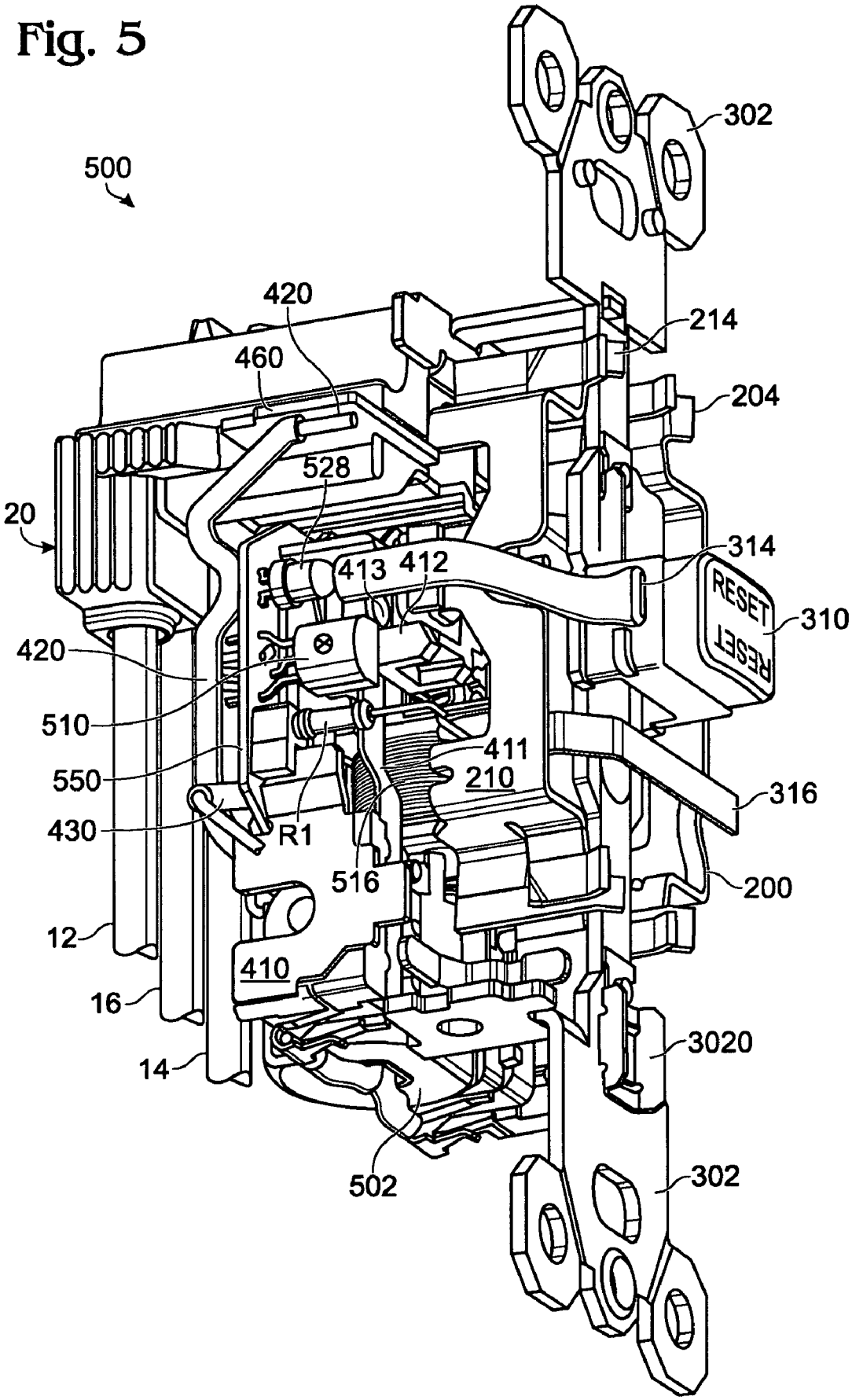
FIG. 5 is a detail side view of the electromechanical assembly of the electrical wiring device shown in FIG. 1.

Referring to FIG. 5, a detail side view of the electromechanical assembly of the electrical wiring device shown in FIG. 1 is disclosed. In this view, the back body 306, separator 304, and cover member 300 are omitted for clarity of illustration. In the previous discussion, it was noted that strap 302 is disposed in the separator and therefore disposed a predetermined distance over the other components disposed on printed circuit board (PCB) 550. Various components such as latch block 412, LED 528, SCR 510, solenoid 516, and test resistor R1 are disposed on PCB 550.

At one end of PCB 550, the toroid assembly 502 is disposed between hot line terminal structure 400 and neutral line terminal 410. At the far end of PCB 550, plug connector 20 is mated with the blade contacts (440, 460, 480) disposed in rear receptacle 308. Black and white conductors 420 and 430, respectively, extend underneath PCB 550, between their respective terminal connections and their respective receptacle blade connections. In the example provided in FIG. 5, hot rear receptacle blade 460 is connected to AC power wire 12 via plug connector 20. Black hot wire 420 is connected to hot receptacle blade 460 and extends under the PCB 550 where it is ultimately terminated at hot terminal structure 400. Similarly, the neutral receptacle blade 480 is connected to white wire 430 which terminates at neutral terminal structure 410. In the view provided by FIG. 5, the neutral cantilever interrupting structure 411 is seen to extend from neutral terminal structure 410. A neutral contact 413 is disposed at the end of the cantilever 411, the neutral contact 413 is, of course, in alignment with fixed contact 212.

Those of ordinary skill in the art will understand that the aforementioned components disposed on PCB 550 implement a GFCI circuit. However, the present invention may be implemented using any suitable type of device including a transient voltage surge suppressor (TVSS), an arc fault circuit interrupter (AFCI), a timer mechanism, an occupancy sensor or other type of sensor, a thermostat, a night light, or a device that includes a combination of the above. Clearly, the form factor of cover member 300 will change accordingly.

Figure 6:
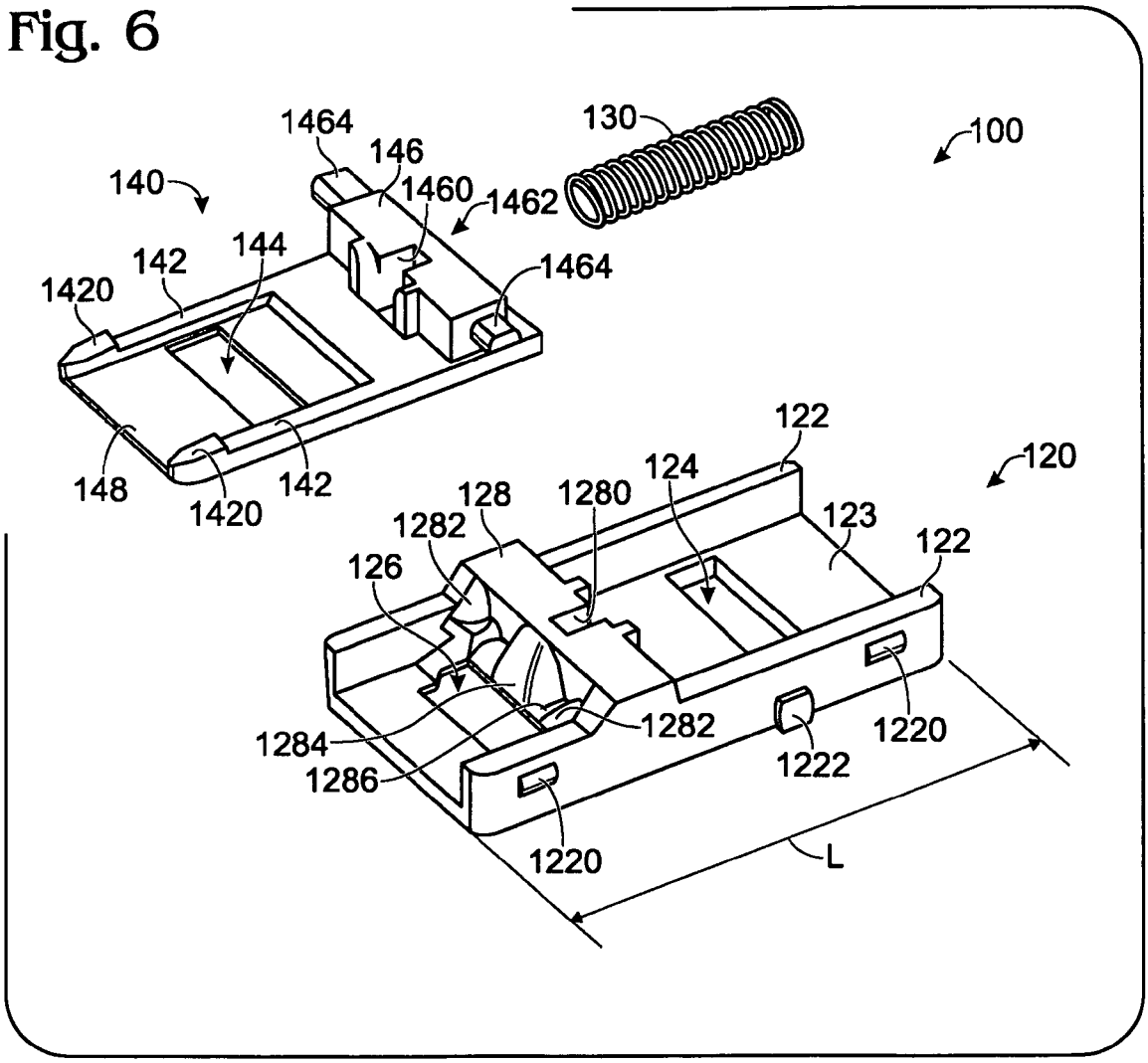
FIG. 6 is an exploded view of a shutter assembly depicted in FIG. 4.

As embodied herein and depicted in FIG. 6, an exploded view of a shutter assembly depicted in FIG. 4 is disclosed. The protective shutter assembly 100 is a frameless mechanism that includes a lower shutter member 120 and an upper shutter member 140. A spring member 130 is disposed between lower shutter 120 and upper shutter 140.

The lower shutter 120 includes side rails 122 and a base member 123 disposed therebetween. Base 123 has a first hot contact aperture 126 and a neutral contact aperture 124 formed therein. A transverse hot blade contact structure 128 is disposed between rails 122 and spans a portion of the first hot contact aperture 126.

Transverse contact structure 128 includes a spring retainer pocket 1280, upper rail guides 1282 and blade contact ramp 1284. As the name suggests, upper rail guides 1282 allows the rails 142 of the upper shutter to slide therebetween, allowing shutter 100 to move between the open position and the closed position. Rail guides 1282 also have a rail stop function.

Upper shutter rail stop members 1420 abut rail guides 1282 to prevent upper shutter 140 from disengaging lower shutter 120 due to the force exerted by spring 130 in the closed position.

Transverse contact structure 128 includes a blade detection geometry implemented by hot blade contact ramp 1284 and ramp base 1286. The hot blade contact ramp 1284 is disposed in a central portion of structure 128. Ramp 1284 has a predetermined width and includes contoured surfaces that recede into the face of structure 128. Those of ordinary skill in the art will recognize that the contoured surfaces will cause foreign objects having a width that is less than the predetermined width of ramp 1284, such as paper clips and the like, to slide off the ramp and strike the base 1286. As a result, a perpendicular force relative to the longitudinal axis of base 123 will be applied by the person wielding the object and the object will be blocked. The predetermined width of ramp 1284, of course, is selected in accordance with the geometry of a proper plug blade. Those of ordinary skill in the art will understand that the contoured surface of ramp 1284 may be of any suitable shape, such as an arcuate shape, a pointed shape, etc.

The upper shutter member 140 includes guide rails 142 having a base member 148 disposed therebetween. As noted above, the guide rails include a stop member 1420 that is configured to abut lower shutter rail guides 1282 to prevent the shutters (120, 140) from disengaging due to the force exerted by the spring 130. An upper shutter hot contact aperture 144 is disposed in base member 148.

Upper shutter member 140 also includes a transverse neutral blade contact structure 146 disposed at one end thereof. Transverse neutral blade contact structure 146 includes a spring retainer pocket 1460, guide rails 142 and, like the lower shutter transverse contact structure 128, a blade detection geometry implemented by neutral blade contact ramp 1462 and ramp base 1465. The neutral blade contact ramp 1462 is disposed at an end portion of shutter 140. In the closed position, neutral blade contact ramp 1462 covers the lower shutter neutral aperture 124. Ramp 1462 has a predetermined width and includes contoured surfaces that recede into the face of structure 146. Again, those of ordinary skill in the art will recognize that the contoured surfaces will cause foreign objects having a width that is less than the predetermined width of ramp 1462, such as paper clips and the like, to slide off the ramp and strike the base 1465. As a result, a perpendicular force relative to the longitudinal axis of base 1465 will be applied by the person wielding the object and the object will be blocked. The predetermined width of ramp 1462 is selected in accordance with the geometry of a proper plug blade. Those of ordinary skill in the art will understand that the contoured surface of ramp 1462 may be of any suitable shape, such as an arcuate shape, a pointed shape, etc.

The protective shutter assembly 100 includes registration members disposed on the frameless shutter sub-assembly. The registration members are configured to position and align the protective shutter assembly 100 within the cover assembly of an electrical wiring device. The lower shutter includes a lower shutter longitudinal registration members 1222 and the upper shutter includes an upper shutter longitudinal registration members 1464. As their names suggest, the lower shutter longitudinal registration members 1222 and the upper shutter longitudinal registration members 1464 are configured to correctly align and position the protective shutter assembly 100 within the cover assembly at a position along a longitudinal axis of the protective shutter assembly. Protective shutter assembly 100 also includes snap-in registration members 1220. The snap-in elements, of course, allows the shutter assembly 100 to be snapped, as a unit, into the cover assembly, provided that the lower shutter longitudinal registration member 1222 and the upper shutter longitudinal registration member 1464 are correctly registered with a corresponding registration structure within the cover assembly.

Note that the protective shutter assembly 100 is characterized by a length (L) that is approximately equal to an inch. In a 15A embodiment, the length (L) is approximately equal to 0.860". In a 20A device, the length (L) is approximately equal to 1.060".

Figure 7:
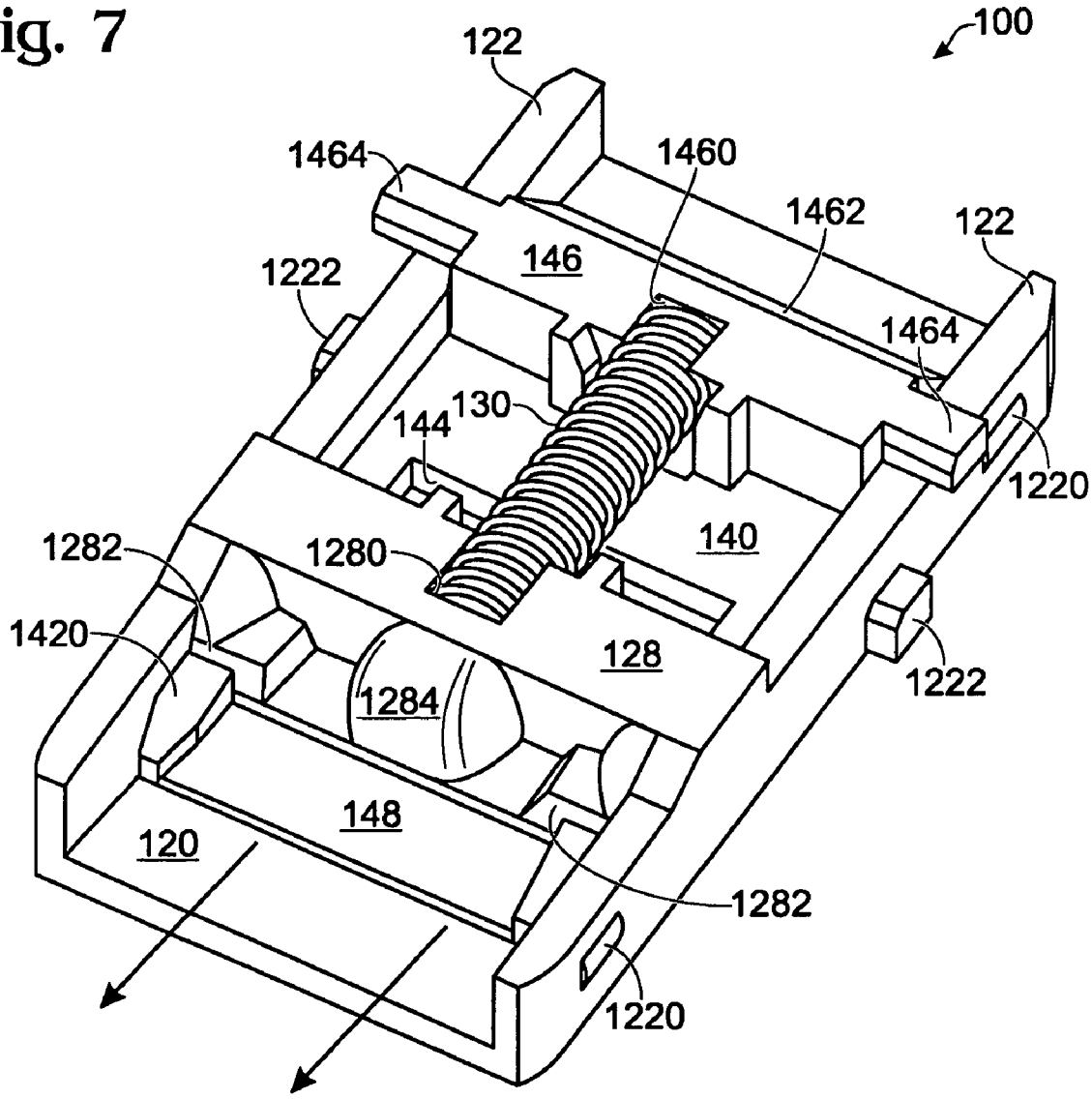
FIG. 7 is a perspective view of the shutter assembly employed in the front cover of the electrical wiring device shown in FIG. 4.

As embodied herein and depicted in FIG. 7, a perspective view of a shutter assembly employed in the front cover of the electrical wiring device shown in FIG. 6 is disclosed. When assembled, the upper shutter 140 is inserted into lower shutter 120 until stop members 1420 extend beyond rail guides 1282 and snap into place. This position represents the closed position, wherein upper transverse structure covers neutral aperture 124 and upper base 148 covers hot aperture 126. The lower shutter member 120 and the upper shutter member 140 are movable relative to each other from the closed position to the open position in response to being simultaneously engaged by the hot plug blade and the neutral plug blade of an electrical plug. To facilitate this movement, shutter members (120,140) are made from a family of plastics having natural lubricity. These include nylon 6-6, Delrin, and Teflon. Shutter members (120,140) may be made from a substrate on which these materials are coated, the substrate having a differing flammability or flexural characteristic.

If a foreign object having a width substantially the same as a hot plug blade is inserted into the hot receptacle opening, the shutter assembly remains closed. The foreign object causes ramp 1284, and therefore, lower shutter 120, to move. However, this foreign object insertion does not cause upper shutter 140 to move relative to shutter 120. As a result, the foreign object inserted into the hot receptacle opening strikes lower base member 148 of the upper shutter. On the other hand, if a foreign object having a width substantially the same as a neutral plug blade is inserted into the neutral receptacle opening, transverse structure 146 will move upper shutter 140 but not move lower shutter 120. Accordingly, the lower base member 123 does not move and the neutral aperture 124 (See FIG. 1) is not exposed. Thus, the foreign object inserted into the neutral receptacle opening strikes lower base member 123.

Only when the hot plug blade and the neutral plug blade of an electrical plug simultaneously engage ramp 1284 and ramp 1462, respectively, will the lower shutter member 120 and the upper shutter member 140 move relative to each other from the closed position to the open position. In the open position, the lower hot aperture 126 is aligned with the upper hot contact aperture 144 and, the inward edge of the lower neutral contact aperture 124 is substantially aligned with the outer edge of ramp 1462. In this position, the lower shutter 120 and the upper shutter 140 allow the plug contact blades to pass through the protective shutter 100 and engage the contacts disposed in the interior of the electrical wiring device.

In another embodiment, the predetermined electrical plug geometry that opens the shutters may include only some of the characteristics that have been described. The geometry may include just one or more of the following: two plug blades separated by a predetermined distance, plug blades contacting the two blade structures simultaneously, a neutral plug blade having a predetermined width, or a hot plug blade having a predetermined width. Plug blade width will not matter if ramps 1284 and/or 1462 approach the widths of their respective contact structures.

The movement of the upper shutter 140 and the lower shutter 120 is effected by spring member 130. The spring member 130 is configured to bias the frameless shutter sub-assembly, i.e., lower shutter 120 and upper shutter 140, in the closed position. Spring member 130 is compressed further in the open position and, therefore, opposes movement of the frameless shutter sub-assembly from the closed position to the open position. Accordingly when the electrical plug is removed, the spring moves the frameless shutter sub-assembly from the open position to the closed position. Stated differently, only a single spring is necessary to effect the closed position of the shutter assembly.

As alluded to above, the protective shutter assembly 100 includes a spring retainer mechanism. The spring retainer mechanism includes lower shutter retainer pocket 1280 and upper shutter retainer pocket 1460. The spring retainer mechanism is configured to retain the spring member 130 within the frameless shutter sub-assembly and substantially prevent the spring member from being separated from the frameless shutter sub-assembly. As those of ordinary skill in the art will appreciate, the protective shutter assembly 100 may be dropped and/or exposed to vibrational and/or mechanical forces during automated assembly. As shown in FIG. 1, retainer pockets (1280, 1460) are equipped with retainer lips that prevent the spring member from being jarred loose.

Figure 8:
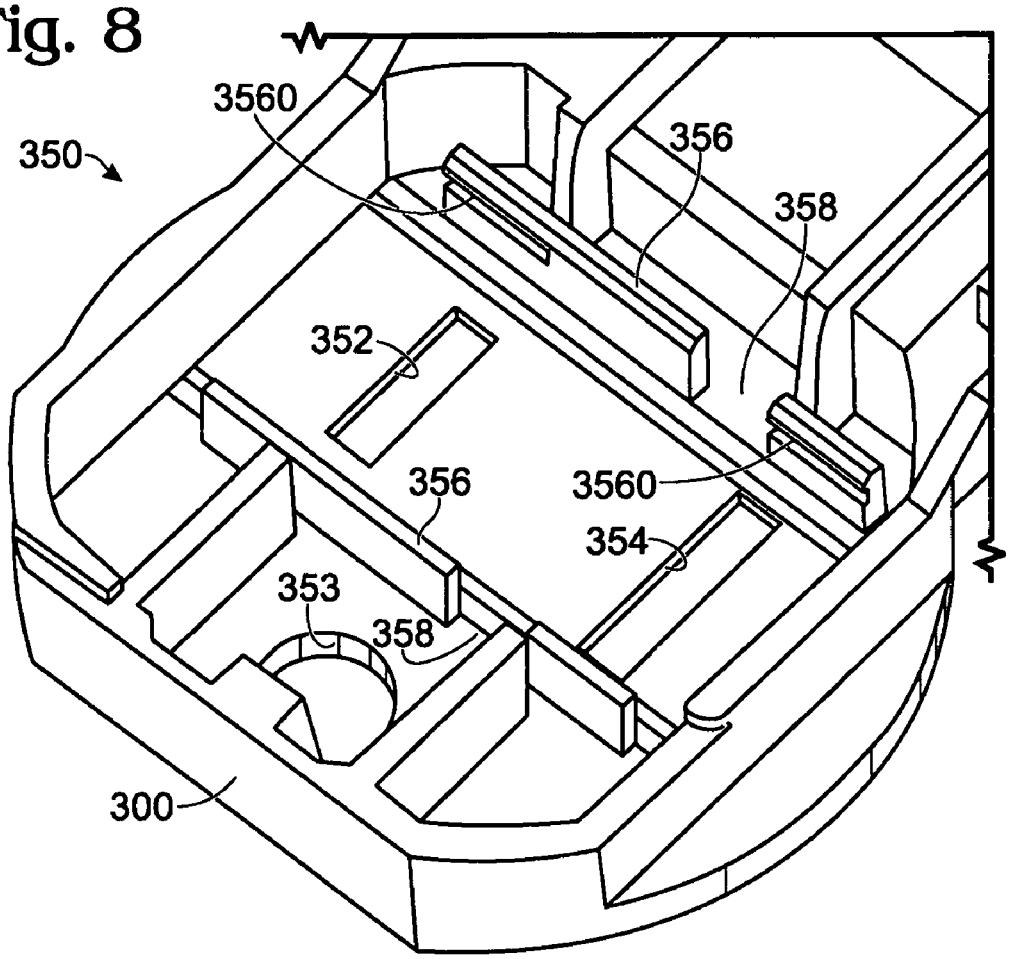
FIG. 8 is a perspective view of the inside portion of the front cover of the electrical wiring device shown in FIG. 1.

Referring to FIG. 8, a perspective view of the inside portion of the raised portion 350 of front cover 300 of the electrical wiring device shown in FIG. 1 is disclosed. The raised portion 350 of cover assembly 300 is shown to include hot receptacle opening 352 and neutral receptacle opening 354. Those of ordinary skill in the art will understand that the shape and size of the receptacle openings is determined by the geometry of the type of service, i.e., 15A, 20A, etc., and the corresponding plug blades. Of course, the cover 300 mates with a wiring device housing that includes a plurality of receptacle contacts. The hot 352, neutral 354, and ground 353 openings are in communication with their corresponding receptacle contacts in the open position. The electrical plug may include pins instead of blades in which case the corresponding receptacle openings are circular instead of rectangular. Ramps (1286,1462) are then configured to allow predetermined pin shapes to open the shutter assembly.

The raised cover assembly 350 includes a pair of cover registration structures 3560, each including a registration alignment key 358 disposed therein. Each alignment key 358 accommodates a lower shutter longitudinal registration member 1222 and an upper shutter longitudinal registration member 1464. The position of alignment key 358 ensures that the protective shutter assembly 100 is positioned within the raised cover assembly 350 such that the hot shutter aperture 126, neutral shutter aperture 124, and the ramp structures (1284, 1462) and base portions (123,148) are correctly aligned with the receptacle openings (352, 354).

Each registration structure 356 includes a registration groove 3560 that is configured to mate with snap-in registration member 1220 (See FIGS. 6-7). As discussed above in some detail, registration member 1220 is configured to snap into registration groove 3560 to couple the frameless protective shutter assembly 100 to the raised cover assembly 350.

Figure 9:
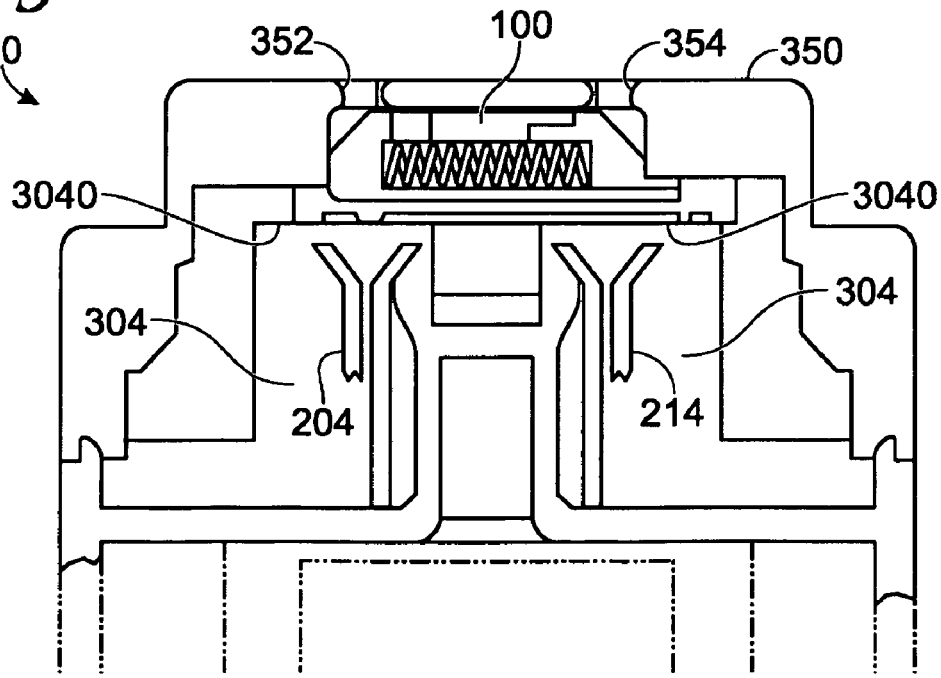
FIG. 9 is a lateral cross sectional view of the electrical wiring device shown in FIG. 1 through the cover, the shutter assembly and the separator.

Referring to FIG. 9, a lateral cross sectional view of the electrical wiring device through the raised cover assembly 350, the shutter assembly 100 and the separator 304 is disclosed. From top to bottom, it is seen that the raised cover portion 350 includes hot blade opening 352 and neutral blade opening 354 disposed in registered alignment with shutter 100 in the manner described above. The receptacle contacts (204), 214) are disposed in substantial alignment under the shutter 100 with the openings (352, 354).

The separator 304 includes a shutter support structure 3040 that is configured to press against the under-side of the shutter when the cover 300, separator 304 and body member 306 are fully assembled. One can imagine electrical wiring device 30 being inadvertently dropped from a height of several feet. Without the support provided by structure 3040, the applied force may be enough to dislodge the shutter 100 from the registered interior of raised cover assembly 350. The shutter support member 3040 holds the shutter 100 securely in place and prevents the shutter 100 from being dislodged from the registration members 356.

Figure 10:
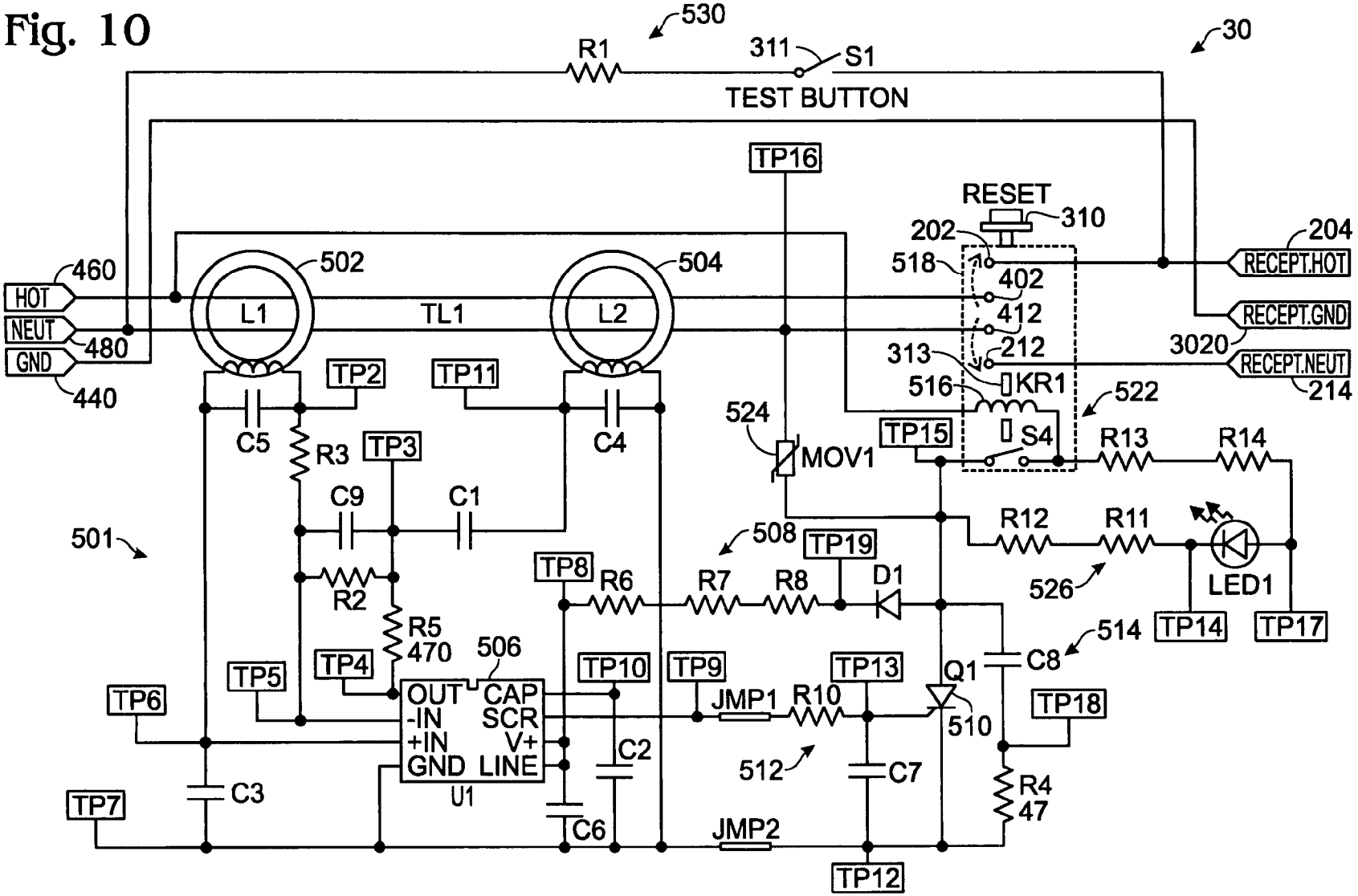
FIG. 10 is a schematic view of a GFCI circuit in accordance with an embodiment of the present invention.

As embodied herein and depicted in FIG. 10, a schematic view of the protective circuit employed in the electrical wiring device of the present invention is disclosed. Moving from left to right in the schematic, it is seen that GFCI 501 includes hot line receptacle blade 460, neutral line receptacle blade 480, and ground receptacle blade 440. On the load side of device 10, there are a pair of user accessible receptacles, each including a hot receptacle terminal 204 and a neutral receptacle terminal 214. As noted above, there are no external terminal elements provided by device 30.

The ground fault circuitry includes a differential transformer 502 which is configured to sense load-side ground faults. Transformer 504 is configured as a grounded neutral transmitter and is employed to sense grounded-neutral fault conditions. Both transformers are disposed in toroid assembly L1. Both differential transformer 502 and grounded-neutral transformer 504 are coupled to detector integrated circuit 506. Detector 506 is powered by a power supply circuit 508 connected to pin $V^+$ on detector 506. The detector output, provided on output pin SCR, is connected to the control input of SCR 510. Filter 512, comprising resistor R10 and capacitor C7, low-pass filter the detector output signal. GFCI 501 also includes a snubber circuit 514 that includes resistor R4 and capacitor C8. Snubber circuit 514 prevents voltage transients from triggering SCR 510.

When SCR 510 is turned ON, solenoid 516 is energized, actuating circuit interrupter 518. Solenoid 516 remains energized for a time period that is typically less than about 25 milliseconds. Circuit interrupter 518 trips, resulting in the line terminals being disconnected from respective load terminals. After the fault condition has been eliminated, the circuit interrupter 518 may be reset by way of reset button 310. In one embodiment, the reset button 310 functionality is purely mechanical in nature and does not include any electrical contacts for test initiation.

It will be apparent to those of ordinary skill in the pertinent art that modifications and variations can be made to circuit interrupter of the present invention depending on contact structure implementation. For example, circuit interrupter 518 may be implemented using a cantilevered contact structure. The line terminals (400, 410) are electrically connected to the receptacle load terminals (204, 214) when the device 30 is reset. When in the tripped state, the line and receptacle contacts are disconnected from each of the other contacts.

GFCI 501 addresses certain end of life conditions by denying power to the load when the device is unable to function. As an example of an end-of-life condition, solenoid 516 is susceptible to burn-out if SCR 510 becomes shorted out, or is permanently turned ON. Solenoid 516 may burn out if it is energized for more than about 1 second. Once the solenoid 516 burns out, the circuit interrupter 518 is incapable of being tripped. Solenoid burn-out prevention is provided by auxiliary switch 522. Auxiliary switch 522 is configured to open when the circuit interrupter 518 is in the tripped position. If SCR 510 is shorted out, or permanently ON, auxiliary switch 522 ensures that solenoid 516 is not permanently connected to a current source. The user may attempt to reset the device 30 by depressing the reset button 310, but the circuit interrupter 518 will immediately trip in response to the current flowing through the solenoid 516. Because the trip mechanism 518 is coupled to the auxiliary switch 522, auxiliary switch 522 is opened before solenoid 516 burns out.

Another failure mode that is addressed by GFCI 501 relates to the end-of-life failure mode of movistor (MOV) 524. MOV 524 is disposed in series with auxiliary switch 522 and trip solenoid 516. This arrangement significantly reduces the probability of damage due to an over-current situation. When MOV 524 reaches end-of-life and shorts out, trip solenoid 516 is energized and auxiliary switch 522 is opened. As previously described, when auxiliary switch 522 opens, the flow of short circuit current is terminated before any damage to GFCI 501 ensues.

GFCI 501 also includes trip indication circuit 526. Trip indication circuit 526 is implemented by placing LED 1 and series resistors (R11-R14) in parallel with auxiliary switch 522. LED1 is configured to emit a visual signal when circuit interrupter 518 and auxiliary switch 522 are in an open state (tripped).

GFCI 501 also includes a test circuit 530. The test circuit 530 is coupled between the line neutral terminal 480 and the hot receptacle terminal 204. The test circuit includes a test button 311 disposed in series with test resistor R1.

Figure 11:
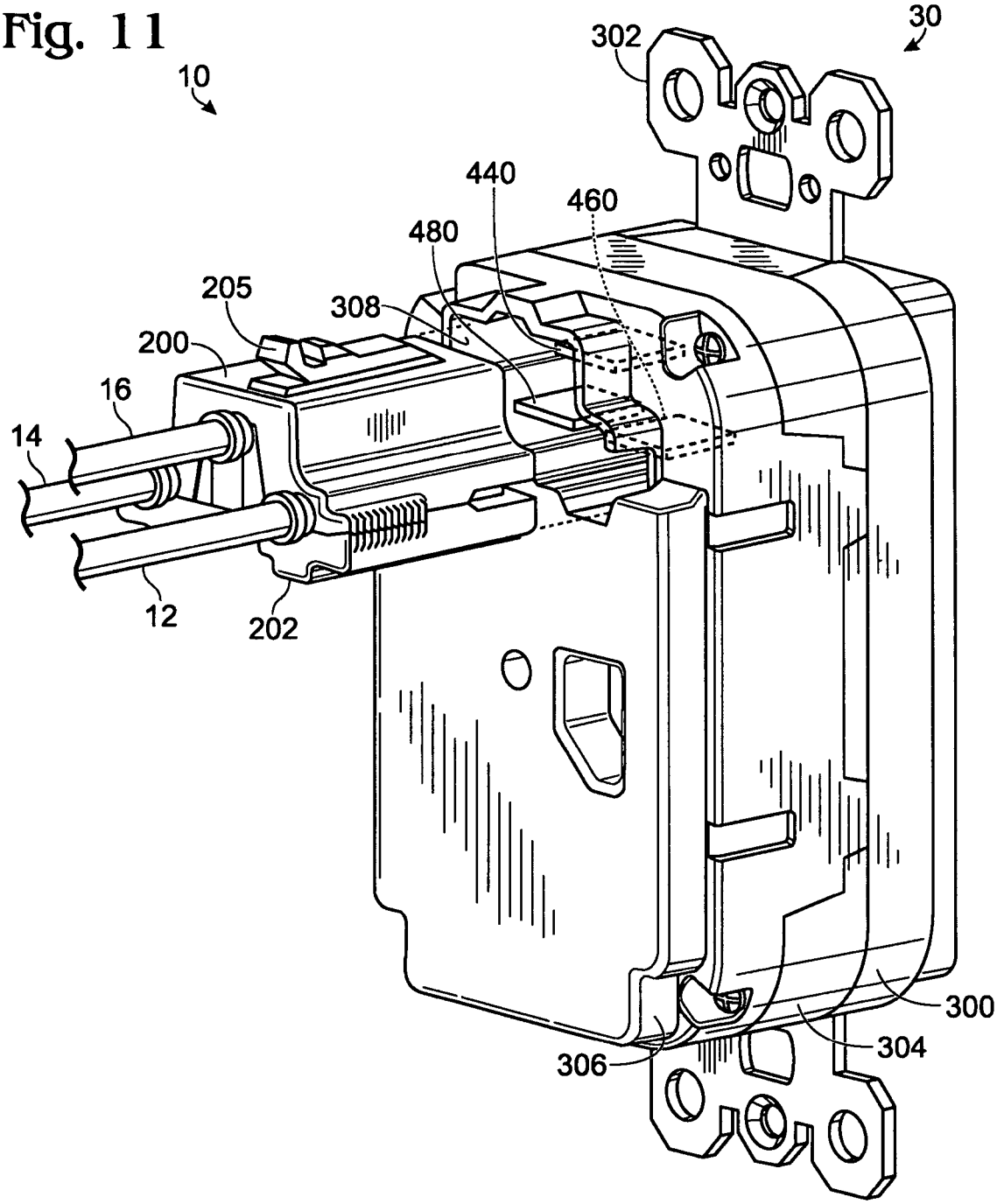
FIG. 11 is a bottom perspective view of an electrical wiring device in accordance with a second embodiment of the present invention.

As embodied herein and depicted in FIG. 11, a perspective view of an electrical wiring system 10 in accordance with a third embodiment of the present invention is disclosed. The wiring device 30 is identical to the device depicted in FIG. 1 and described herein. Note that Receptacle 308 is shaped to accommodate both plug connector 20 embodiments. As before, receptacle 308 includes hot line receptacle blade 460, neutral line receptacle blade 480, and ground receptacle blade 440. Of course, each male contact blade (440, 460, 480) mates with a corresponding female contact mechanism in plug connector 20.

Like the previous embodiment, plug connector 20 aligns the conductors (12,14,16) with the contacts disposed therein. What is different from the previous embodiment is the 180° configuration, i.e., conductors (12,14,16) and the internal plug contacts are arranged, substantially, in a 180° angle. Housing 200 includes latch mechanism 205. When plug connector 20 is inserted into receptacle 308, latch mechanism 205 prevents plug 20 from being pulled out of receptacle 308.

Latch mechanism 205 is configured to meet Underwriter's Laboratories (UL) standards for a locking connector. In this case, UL requires that a static pull test of 20 pounds be applied to the connector for one minute. During the test, plug connector 20 may not separate from receptacle 308. During operation, latch mechanism 205 flexes upon insertion of plug connector 20. The flexure latch mechanism 205 relaxes to a non-flexed position upon successful locking of plug connector 20 to receptacle 308, and emits an audible snapping sound or visual indication that locking has been achieved. Flexible latch mechanism 205 may also be configured to be accessible to the finger or to a tool when plug connector 20 is locked to receptacle 308. In this embodiment, when latch mechanism 205 is accessed and flexed manually, or by the tool, plug connector 20 can be removed from receptacle 308. The flexure is oriented in a direction opposite to the insertion direction in order to meet requirements in Underwriters Laboratories (UL) standards. In another embodiment, plug connector 20 can be locked into receptacle 308 using screws or any number of fastening means familiar to those skilled in the art.

Those of ordinary skill in the art will recognize that any suitable materials may employed in fabricating plug connector 20. In one embodiment, plug housing 200 is formed from injection molded plastic, polycarbonate, or other polymer based materials. The plug connector contacts may be fabricated using any suitable conductive material such as a copper alloy material. Plug connector housing 200 may be fabricated by coupling an upper housing to a lower housing, i.e., the upper housing is snapped onto lower housing to thereby enclose and terminate wires (12,14,16) in plug connector 20.

In one embodiment, the female electrical contacts disposed in plug connector 20 may include a wire seat portion that accommodates the wire conductor. The wire conductor (12, 14,16) is subsequently bonded to the seat portion. Each female contact also includes two exterior spring contact members and an interior spring contact member configured to hold the male contact blade therebetween. When the male receptacle contact blade (460, 480, 440) are inserted, the exterior spring contact members separate from the interior spring contact member to receive and hold the male contact blade firmly therebetween. Reference is made to U.S. Pat. No. 6,994,585, which is incorporated herein by reference as though fully set forth in its entirety, for a more detailed explanation of the female contact arrangement described herein.

In an alternate embodiment of the present invention, the female contacts may be pre-disposed in either the upper portion or in the lower portion of housing 200. In this embodiment, each female contact is equipped with an insulation-displacement blade element. Of course, when the upper housing portion is snapped onto the lower housing portion, or vice-versa, the blade element cuts through and displaces the insulation on the wire (12,14,16) until electrical continuity is established between the wire (12,14,16) and the female contact. In yet another alternate embodiment of the present invention, the female contacts in plug 20 may be terminated to wire leads at the factory. The pre-terminated leads may be coupled to wires (12,14,16) using twist-on wire connectors. Reference is made to U.S. Pat. No. 6,994,585, which is incorporated herein by reference as though fully set forth in its entirety, for a more detailed explanation of the plug connector termination methods employed by the present invention.

Figure 12:
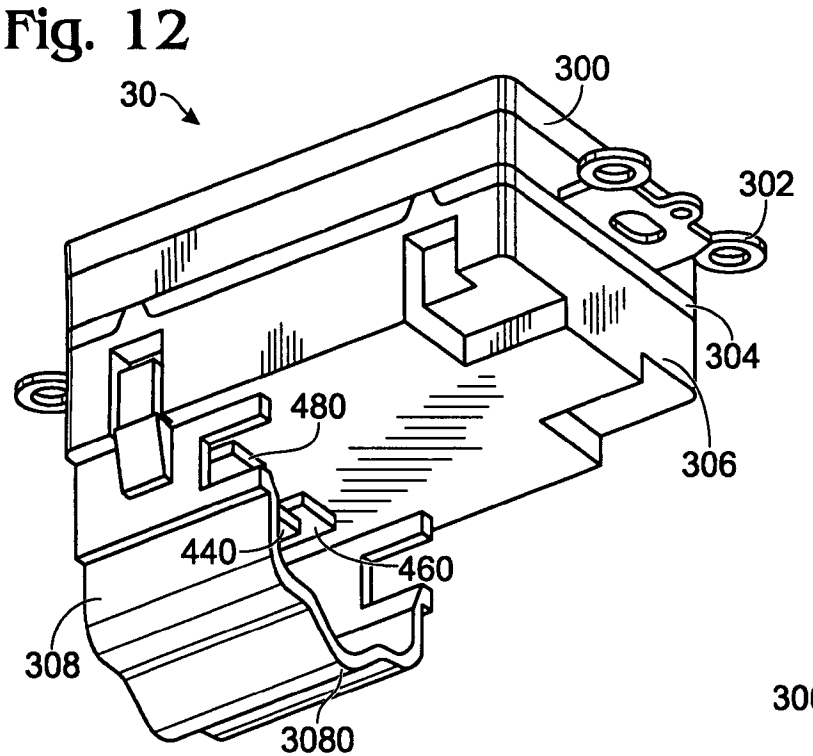
FIG. 12 is a bottom perspective view of an electrical wiring device in accordance with a third embodiment of the present invention.

As embodied herein and depicted in FIG. 12, a bottom perspective view of an electrical wiring device 30 in accordance with a second embodiment of the present invention is disclosed. This embodiment features a cowled external rear receptacle 308 that may be employed with the plug connector 20 shown in FIG. 11. Receptacle 308 includes a raised portion that is configured to accommodate the latch 205. Comparing FIG. 12 with FIG. 4, the electrical wiring device is functionally identical, the difference being the cowled external rear receptacle 308 and the mechanical configuration of the rear receptacle blades (440,460, 480) disposed therein.

Figure 13:
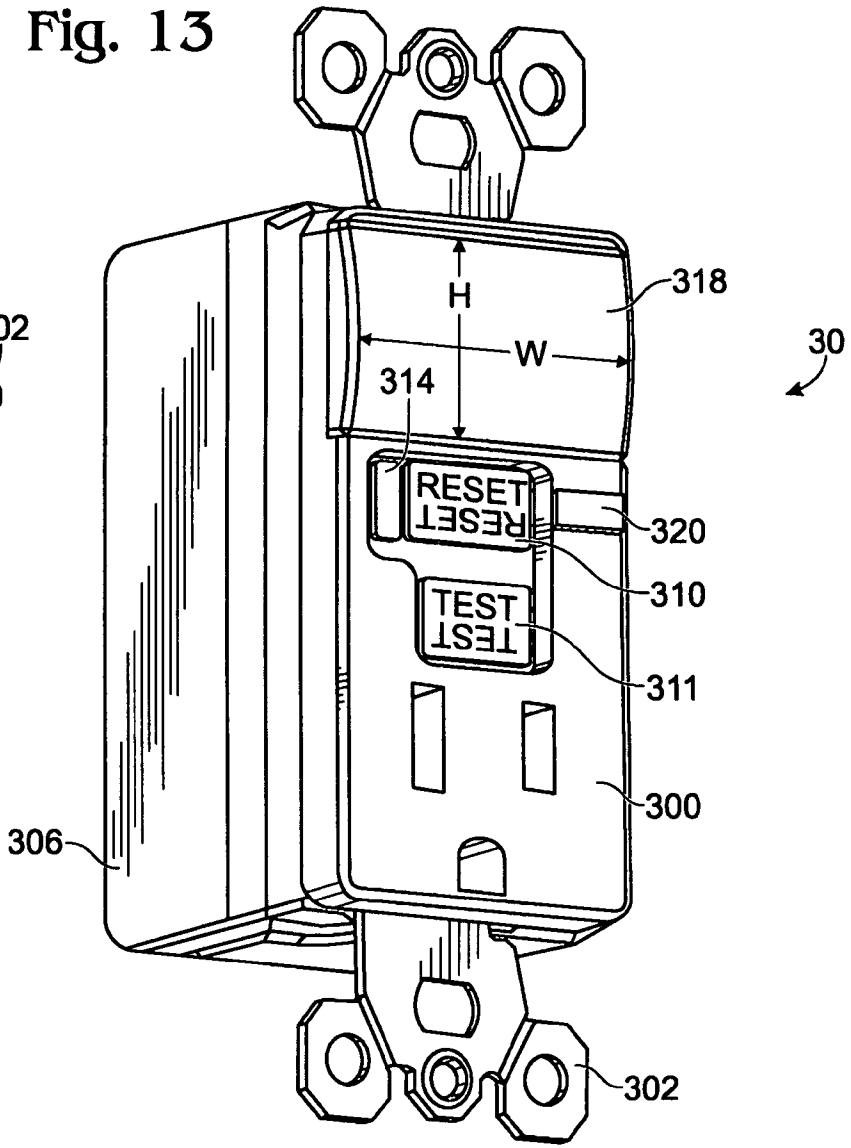
FIG. 13 is a perspective view of a GFCI/Light combination device in accordance with a fourth embodiment of the present invention.

As embodied herein and depicted in FIG. 13, GFCI/Light combination device 1100 is disclosed. The electrical wiring device 1100 includes a cover member 300 coupled to a rear body portion 306. The form factor of rear body member 306 is substantially identical to the rear portion 306 of the wiring device depicted in FIGS. 1-12. Wiring device 300 includes a GFCI circuit of the type disclosed in FIGS. 1-12, and a light source disposed under lens cover 318. This may be accomplished by disposing the light source(s) under lens cover on either side of strap member 302. In an aspect of the embodiment, the light source disposed under lens cover 318 functions as a pilot light by illuminating the ambient environment surrounding the electrical wiring device. The light source is connected to the line terminal elements in this embodiment. Accordingly, the light source is continuously energized as long as power is being provided to the device.

In another embodiment, the light source functions as a circuit status indicator and is connected to the load terminal elements. The light is, therefore, energized when device 30 is in the reset state and the light is OFF when the device is tripped. The light source may be implemented using any suitable device, such as an LED. However, the light source may be implemented using a neon source, an incandescent source, etc.

The light source may be implemented using a single-element light source or a multi-element light source. For example, twin LEDs may be disposed under lens cover 318. Those of ordinary skill in the art will understand that the wavelength of the illumination produced by the light source will depend on the type of source used, and may be selected as a function of the task being performed by the light source; e.g., a night-light, a status indicator, a room illuminator, etc.

Those of ordinary skill in the art will also understand that the lens cover 318 may be made of a either a clear or a translucent material in accordance with design factors such as the type of light source, the wavelength radiated by the light source, the desired intensity, or softness, of the illumination, the function of the light, and other considerations. The lens cover 318 may be removable from the housing cover 300 for access to the light source.

Figure 14:
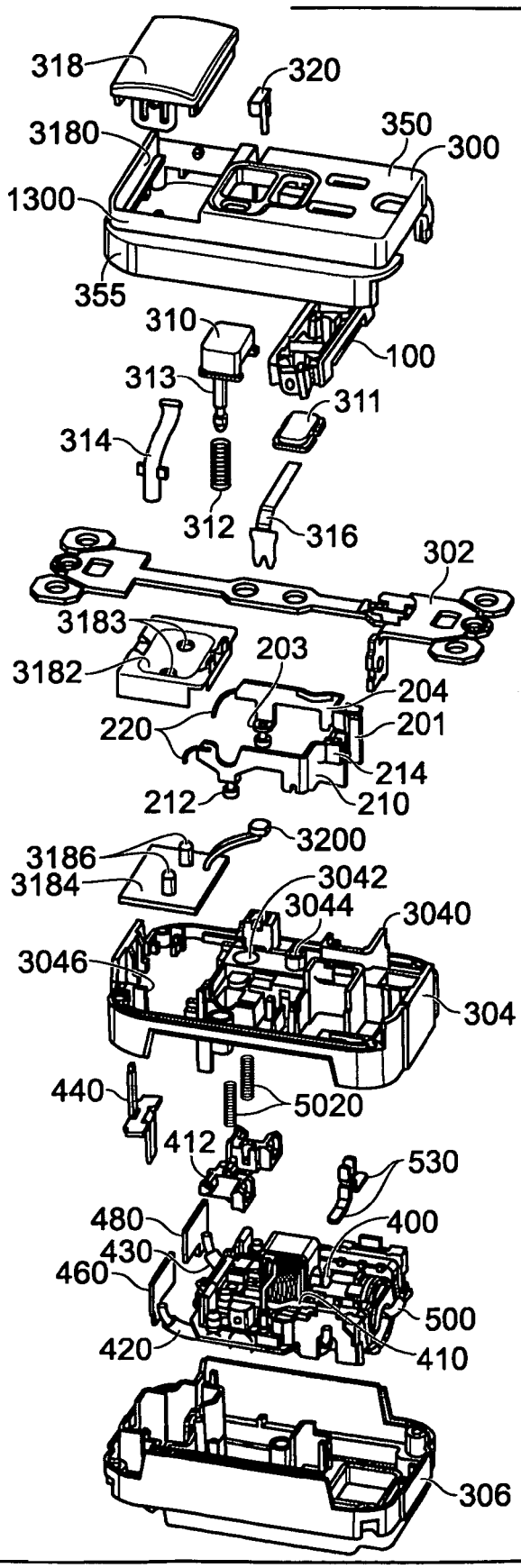
FIG. 14 is an exploded view of the electrical wiring device depicted in FIG. 13.

Referring to FIG. 14, an exploded view of the electrical wiring device depicted in FIG. 13 is disclosed. The electrical wiring device 30 includes only one receptacle disposed in cover member 300. The receptacle is configured to accommodate a single shutter assembly 100 as shown.

At the other end of the device 30, lens element 318 is disposed within light aperture 3180. Of course, the light reflector element 3182 is also disposed in aperture 3180 under the lens 318. LEDS 3186, which are disposed on an auxiliary PCB 384, are mounted within apertures 3183 formed in the reflector 3182. Sensor element 3200 is also mounted on the PCB 3184 as shown. Sensor 3200 includes a flexible lead that allows it to be mounted within sensor lens element 320.

Cover member 300 also includes lateral skirt portions 355 which are configured to cover the lateral portions of the face receptacle terminal structures (200, 210). In the exploded view, the reset button 310 and reset pin 313 are clearly shown. The reset button 310 is accessible via the front cover. The pin portion 313 of reset button 310 is inserted into spring member 312 and a corresponding aperture 3042 within separator 304. The reset pin 313, of course, is ultimately disposed within the latch block 412 and is configured to actuate the latch block 412 between a reset position and a tripped position.

The test button 311 is also accessible via the front cover and is employed by a user to move the test blade 316 in a downward direction. A lead from a test resistor R1 (not shown in this Figure) extends from tower 3044. When the test blade 316 is pressed by the user in a downward direction such that it contacts the lead of resistor R1, a current path is established between the line neutral and the load hot to simulate a fault condition. See also FIG. 10.

The separator member accommodates the hot receptacle terminal structure 201 and the neutral receptacle terminal structure 210. These terminal structures are different than the ones employed in earlier embodiments. The hot receptacle terminal structure 201 includes a hot fixed contact 202 disposed at one end thereof, and hot receptacle contact structures 204 formed at the other end. In similar fashion, the neutral receptacle terminal structure 210 includes a neutral fixed contact 212 disposed at one end thereof and neutral receptacle contact structure 214 formed at the other end. Therefore, only one end of device 30 includes a shutter assembly 100 disposed between receptacle portion 350 and the lone set of hot and neutral receptacle contacts (204, 214). Finally, leads 220 extend from the fixed contact end of each terminal structure (201, 210) and are terminated at corresponding contact locations on PCB 3184. The leads 220, of course, provide PCB 3184 with AC power.

As described previously, separator 304 includes a shutter support structure 3040 disposed at either end of the protective shutter assembly 100. The mounting strap 302 is also disposed within the separator member 304 between the hot receptacle terminal structure 201 and the neutral receptacle terminal structure 210. Separator 304 also includes an aperture 3046 that is configured to support and accommodate reflector element 3182.

The electromechanical assembly 500, the back body 306 and the remaining components shown in FIG. 14 are either identical or substantially similar to those described in the text associated with FIG. 4 and elsewhere in this specification.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A shock-proof electrical wiring system for use in an AC electrical power distribution circuit including a plurality of AC electric power transmitting wires disposed between an AC power distribution point and a device box, a portion of the plurality of AC electric power transmitting wires being routed into an interior portion of the device box, the system comprising:

a connector device including a connector housing, a plurality of connector contacts disposed substantially inaccessible to a user within the connector housing, the plurality of connector electrical contacts being connected to a termination arrangement, the termination arrangement being configured to be connected to the portion of the plurality of AC electric power transmitting wires; and an electrical wiring device comprising a housing assembly that includes at least one set of user-accessible receptacle openings disposed in a front major surface thereof in operative alignment with at least one shutter assembly configured to move from a closed position to an open position only in response to engaging a set of plug blades, the at least one shutter assembly being secured within the housing assembly by a plurality of registration elements disposed along at least two orthogonal axes of the shutter assembly such that the at least one shutter assembly is substantially fixed along a first axis of the at least two axes, portions of the at least one shutter assembly being slidably movable between an open position and a closed position along the second axis of the at least two axes, the housing assembly including an AC circuit assembly coupled to at least one set of receptacle contacts disposed in substantial alignment with the at least one shutter assembly, the housing assembly further including a power input arrangement formed in a rear portion thereof, the power input arrangement including a set of power contacts configured to mate with the plurality of connector contacts within the connector housing to thereby establish electrically continuous paths between the plurality of AC electric power transmitting wires and the AC circuit assembly and the at least one set of receptacle contacts, the portion of the AC power transmitting wires being stowed within the interior portion of the device box when the electrical wiring device is mounted to the device box.

2. The system of claim 1, wherein a first portion of the connector housing is insertable into the power input arrangement and oriented along a first connector housing axis and a second portion of the connector housing is oriented along a second connector housing axis orthogonal to the first connector housing axis.

3. The system of claim 1, where the AC circuit assembly is coupled to a light source.

4. The system of claim 3, wherein the light source is selected from a group of light sources that includes a nightlight, a trip indicator, an end-of-life indicator, a room illuminator, and/or a pilot light.

5. The system of claim 3, wherein the light source further comprises:

a light assembly including at least one light emitting element coupled to a lighting control circuit, the at least one light emitting element being covered by a lens element disposed in the front major surface having a lateral dimension substantially equal to the width of the electrical wiring device; and a sensor assembly including a sensor lens disposed in the front major surface and a light sensor coupled to the lighting control circuit and in optical communication with the sensor lens.

6. The system of claim 1, further comprising:

a fault detection circuit coupled to the power input arrangement and the AC circuit assembly, the fault detection circuit being configured to detect at least one fault condition propagating in the electrical distribution system and provide a trip signal in response thereto; and a circuit interrupter assembly coupled to the fault detection circuit, the circuit interrupter assembly including a set of movable contacts configured to open in response to the trip signal, the electrically continuous path between the plurality of AC electric power transmitting wires and the at least one set of receptacle contacts being interrupted in a tripped state.

7. The system of claim 6, further comprising a reset mechanism coupled to the circuit interrupter assembly, the reset mechanism being configured to close the movable contacts to reestablish electrical continuity between the plurality of AC electric power transmitting wires and the at least one set of receptacle contacts in a reset state.

8. The system of claim 6, further comprising a test circuit configured to introduce a simulated fault signal, the at least one fault condition including the simulated fault signal.

9. The system of claim 6, wherein the circuit interrupter assembly further comprises:

a solenoid coupled to the fault detection circuit, the solenoid being energized in response to the trip signal to open the set of movable contacts; and an auxiliary switch coupled to the solenoid, the auxiliary switch being configured to open in response to the solenoid being energized, the opened auxiliary switch interrupting a current path to the solenoid to thereby deenergize the solenoid.

10. The system of claim 9, wherein the auxiliary switch is disposed in series with the solenoid.

11. The system of claim 10, further comprising a movistor disposed in series with the auxiliary switch.

12. The system of claim 1, wherein the connector device is configured as a plug connector device and the power input arrangement is configured as a power input receptacle.

13. The system of claim 1, wherein the connector housing further comprises a latch member, the latch member being configured to engage a latching portion disposed on the power input arrangement to secure the connector housing within at least a portion of the power input arrangement.

14. The system of claim 1, wherein the connector device includes female electrical contacts substantially inaccessible to a user such that the connector device is safely removable from the power input arrangement when the electrical wiring system is energized.

15. The system of claim 1, wherein a first set of the plurality of registration elements include at least one support surface disposed substantially parallel to the front major surface, the first axis being substantially parallel to both the front major surface and the at least one support surface.

16. The system of claim 1, wherein a second set of the plurality of registration elements include registration grooves disposed within spaced apart lateral support members formed in the housing assembly substantially parallel to the second axis, the second axis being substantially orthogonal to the longitudinal axis of the electrical wiring device.

17. The system of claim 1, wherein the at least one set of user-accessible receptacle openings includes two sets of user-accessible receptacle openings and the at least one shutter assembly includes two shutter assemblies, each shutter assembly being disposed in alignment with a corresponding set of the two sets of user-accessible receptacle openings.

18. The system of claim 1, wherein the at least one shutter assembly further comprises:

a frameless shutter sub-assembly movable between a closed position and an open position, the frameless shutter sub-assembly being configured to move from the closed position to the open position in response to engaging at least one plug blade having a predetermined plug blade geometry;

a spring member disposed within the frameless shutter sub-assembly, the spring member being configured to bias the frameless shutter sub-assembly in the closed position;

at least one retainer element disposed in the frameless shutter sub-assembly, the at least one retainer element being configured to retain the spring member within the frameless shutter sub-assembly; and at least one registration member disposed on the frameless shutter sub-assembly, the at least one registration member being configured to position and align the protective shutter assembly within the cover assembly along the second axis.

19. The system of claim 18, wherein the frameless shutter sub-assembly further comprises a first shutter member coupled to a second shutter member, the first shutter member and the second shutter member being movable relative to each other to effect the open position only if both the first shutter member and the second shutter member are simultaneously engaged by a hot plug blade and a neutral plug blade.

20. The system of claim 19, wherein the first shutter member includes a first hot contact aperture and a neutral contact aperture, and the second shutter member includes a second hot contact aperture.

21. The system of claim 20, wherein the first shutter member and the second shutter member are movable relative to each other from the closed position to the open position in response to being simultaneously engaged by the hot plug blade and the neutral plug blade such that the first hot contact aperture is aligned with the second hot contact aperture and the neutral contact aperture is unblocked by the second shutter member.

22. The system of claim 20, wherein the first shutter member includes a hot blade contact structure and the second shutter member includes a neutral blade contact structure with the spring member being disposed therebetween.

23. The system of claim 19, wherein the at least one retainer element includes a first retainer element disposed in the first shutter member and a second retainer element disposed in the second shutter member.

24. The system of claim 19, wherein the first shutter member and the second shutter member each include a plug blade detection structure disposed thereon, the plug blade detection structure being configured to engage a plug blade having predetermined characteristics and not engage objects not having the predetermined characteristics.

25. The system of claim 1, wherein the power input arrangement includes male contacts extending from a rear major surface of the housing assembly.

26. The system of claim 25, wherein the power input arrangement is configured as a cowled plug receptacle having a protective portion extending in a direction substantially parallel to the rear major surface.

27. The system of claim 26, wherein the cowled plug receptacle includes a latching portion configured to engage a latch member disposed on the connector device to secure the connector housing within the cowled plug receptacle.

28. The system of claim 25, wherein a portion of the male contacts that mates with the connector device extends in a direction substantially parallel to the rear major surface.

29. A shock-proof electrical wiring system for use in an AC electrical power distribution circuit including a plurality of AC electric power transmitting wires disposed between an AC power distribution point and a device box, a portion of the plurality of AC electric power transmitting wires being routed into an interior portion of the device box, the system comprising:

a connector device including a connector housing, a plurality of female electrical contacts disposed substantially inaccessible to a user within the connector housing, the plurality of female electrical contacts being internally connected within the housing to a plurality of wire segments, the plurality of wire segments being configured to be connected to the portion of the plurality of AC electric power transmitting wires; and an electrical wiring device including a cover assembly having at least one set of user-accessible receptacle openings disposed in a major cover surface thereof in operative alignment with at least one shutter assembly, the at least one shutter assembly being configured to move from a closed position to an open position in response to engaging at least one set of plug blades and otherwise preventing an external object from making contact with the at least one set of face receptacle contacts, the device also including a body member having an AC circuit assembly coupled to the at least one set of face-receptacle contacts disposed in substantial alignment with the at least one shutter assembly, the body member further including a power input arrangement formed in a rear portion thereof, the power input arrangement including a set of male power contacts configured to mate with the plurality of female connector contacts within the connector housing when the connector device is mated with the power input arrangement to thereby establish an electrically continuous path between the AC circuit assembly and the plurality of AC electric power transmitting wires, the connector device being safely removable from the electrical wiring device when the electrical wiring system is energized.

30. The system of claim 29, wherein the portion of the AC power transmitting wires are stowed within the interior portion of the device box when the electrical wiring device is mounted to the device box.

31. The system of claim 29, wherein the at least one shutter assembly is a frameless shutter assembly.

32. The system of claim 29, wherein the at least one shutter assembly is supported within the cover assembly by registration elements disposed along at least two orthogonal axes of the shutter assembly such that the at least one shutter assembly is substantially fixed along a first axis of the at least two axes, the shutter assembly being movable between the open position and the closed position.

33. The system of claim 32, wherein a first set of the registration elements include at least one body member support surface disposed substantially parallel to the major cover surface, the first axis being substantially parallel to both the major cover surface and the at least one body member support surface.

34. The system of claim 32, wherein a second set of registration elements include registration grooves disposed within spaced apart lateral support members formed in the cover assembly substantially parallel to the second axis, the second axis being substantially orthogonal to the longitudinal axis of the electrical wiring device.

35. The system of claim 32, wherein the at least one shutter assembly further comprises:

a frameless shutter sub-assembly movable between a closed position and an open position, the frameless shutter sub-assembly being configured to move from the closed position to the open position in response to engaging at least one plug blade having a predetermined plug blade geometry;

a spring member disposed within the frameless shutter sub-assembly, the spring member being configured to bias the frameless shutter sub-assembly in the closed position;

at least one retainer element disposed in the frameless shutter sub-assembly, the at least one retainer element being configured to retain the spring member within the frameless shutter sub-assembly; and at least one registration member disposed on the frameless shutter sub-assembly, the at least one registration member being configured to position and align the protective shutter assembly within the cover assembly along the second axis.

36. The system of claim 35, wherein the frameless shutter sub-assembly further comprises a first shutter member coupled to a second shutter member, the first shutter member and the second shutter member being movable relative to each other to effect the open position only if both the first shutter member and the second shutter member are simultaneously engaged by a hot plug blade and a neutral plug blade.

37. The system of claim 29, wherein the at least one set of user-accessible receptacle openings includes two sets of user-accessible receptacle openings and the at least one shutter assembly includes two shutter assemblies, each shutter assembly being disposed in alignment with a corresponding set of the two sets of user-accessible receptacle openings.

38. The system of claim 29, wherein a first portion of the connector housing is insertable into the power input arrangement and oriented along a first connector axis and a second portion of the connector housing is oriented along a second connector axis orthogonal to the first connector axis.

39. The system of claim 29, wherein the power input arrangement is configured as a cowled plug receptacle having a protective portion extending in a direction substantially parallel to a major surface of the rear portion.

40. The system of claim 29, further comprising a light assembly including at least one light emitting element coupled to a lighting control circuit, the at least one light emitting element being covered by a lens element disposed in the front major surface having a lateral dimension substantially equal to the width of the electrical wiring device.

41. The system of claim 40, further comprising a sensor assembly including a sensor lens disposed in the front major surface and a light sensor coupled to the lighting control circuit and in optical communication with the sensor lens.

42. The system of claim 29, further comprising:

a fault detection circuit coupled to the power input arrangement and the AC circuit assembly, the fault detection circuit being configured to detect at least one fault condition propagating in the electrical distribution system and provide a trip signal in response thereto; and a circuit interrupter assembly coupled to the fault detection circuit, the circuit interrupter assembly including a set of movable contacts configured to open in response to the trip signal, the electrically continuous path between the plurality of AC electric power transmitting wires and the at least one set of receptacle contacts being interrupted in a tripped state.

43. A shock-proof electrical wiring system for use in an AC electrical power distribution circuit including a plurality of AC electric power transmitting wires disposed between an AC power distribution point and a device box, a portion of the plurality of AC electric power transmitting wires being routed into an interior portion of the device box, the system comprising:

an insertable connector assembly including a plurality of connector contacts inaccessibly disposed in a connector housing characterized by a predetermined form factor, the connector assembly including a termination arrangement electrically coupled to the plurality of connector contacts and configured to terminate the portion of the plurality of AC electric power transmitting wires; and an electrical wiring device including a cover assembly having at least one set of user-accessible receptacle openings disposed in a major surface thereof and at least one frameless shutter assembly disposed in the cover assembly in substantial alignment with the at least one set of user-accessible receptacle openings, the at least one shutter assembly being configured to move from a closed position to an open position only in response to engaging a set of plug blades, the device including a body member having a power input receptacle substantially conforming to the predetermined form factor and formed in a rear portion thereof, the power input receptacle including a set of power contacts configured to mate with the plurality of connector contacts when the connector assembly is inserted in the power input receptacle preventing a foreign object from accessing an interior portion of the power input receptacle, at least one set of face receptacle contacts being coupled to the set of power contacts by a corresponding set of conductive paths and disposed in substantial alignment with the at least one shutter assembly, a fault protection mechanism being configured to interrupt at least one of the conductive paths in response to detecting a fault condition.

44. The system of claim 43, wherein the first shutter member and the second shutter member each include a plug blade detection structure disposed thereon, the plug blade detection structure being configured to engage a plug blade having predetermined characteristics and not engage objects not having the predetermined characteristics.

45. A shock-proof electrical wiring system for use in an AC electrical power distribution circuit including a plurality of AC electric power transmitting wires disposed between an AC power distribution point and a device box, a portion of the plurality of AC electric power transmitting wires being routed into an interior portion of the device box, the system comprising:

a connector device including a housing, a plurality of female electrical contacts disposed substantially inaccessible to a user within the housing, the plurality of female electrical contacts being connected to a termination arrangement, the termination arrangement being configured to be connected to the portion of the plurality of AC electric power transmitting wires; and an electrical wiring device including a cover assembly having a power output arrangement disposed in a major surface of the cover assembly, the power output arrangement including at least one set of user-accessible receptacle openings disposed in the major cover surface in operative alignment with at least one shutter assembly, the at least one shutter assembly being configured to move from a closed position to an open position in response to engaging at least one plug blade having a predetermined plug blade geometry and preventing an external object not having the predetermined plug blade geometry from making contact with the at least one set of face receptacle contacts, the electrical wiring device further including a body member having an AC circuit assembly coupled to at least one set of face-receptacle contacts disposed in substantial alignment with the at least one shutter assembly, the body member further including a power input arrangement formed in a rear portion thereof, the power input arrangement including a set of male power contacts configured to mate with the plurality of female connector contacts within the connector housing when the connector device is mated with the power input arrangement to thereby establish an electrically continuous path between the AC circuit assembly and the plurality of AC electric power transmitting wires and preventing a foreign object from making contact with the set of male contacts, the connector device being safely removable from the electrical wiring device when the electrical wiring system is energized.

46. The system of claim 45, wherein the first shutter member and the second shutter member each include a plug blade detection structure disposed thereon, the plug blade detection structure being configured to engage a plug blade having predetermined characteristics and not engage objects not having the predetermined characteristics.

* * * * *